United States Patent [19]

Aterianus et al.

[11] 4,231,558

[45] Nov. 4, 1980

[54] APPARATUS FOR ACCUMULATING ARTICLES SUCH AS BAGS

[75] Inventors: John S. Aterianus; Donald C. Crawford, both of Green Bay, Wis.

[73] Assignee: FMC Corporation, San Jose, Calif.

[21] Appl. No.: 904,133

[22] Filed: May 8, 1978

[51] Int. Cl.[2] ..... B65H 39/08

[52] U.S. Cl. ..... 270/60; 271/81; 414/27; 414/47; 414/81; 493/186

[58] Field of Search ..... 414/27, 47, 49, 52, 414/72, 76, 81; 271/81, 82, 95; 270/60; 93/93 DP, 93 HT; 198/422, 424

[56] References Cited

U.S. PATENT DOCUMENTS

| | | | |
|---|---|---|---|
| 344,731 | 6/1886 | Fenner | 271/81 |
| 374,465 | 12/1887 | Fenner | 271/81 |
| 1,068,597 | 7/1913 | Main | 270/60 |
| 2,703,393 | 3/1955 | Bird | 339/183 |
| 3,105,422 | 10/1963 | Simpson et al. | 93/93 DP |
| 3,176,976 | 4/1965 | Hepp | 271/95 X |
| 3,431,828 | 3/1969 | Crawford et al. | 93/93 HT X |
| 3,462,026 | 8/1969 | Maccherone | 414/27 |
| 3,649,948 | 3/1972 | Porter | 339/183 X |

*Primary Examiner*—L. J. Paperner

*Attorney, Agent, or Firm*—A. J. Moore; L. J. Pizzanelli

[57] ABSTRACT

A bag machine and method includes a continuously driven rotary drum for making articles such as bags from a folded web of thermosealing material. A bag stripping and accumulating mechanism is driven in timed relation with the bag making drum for removing each bag from the drum and accumulating a predetermined plurality of bags in groups before depositing the groups of bags at a location such as on the pins of a wicket conveyor when the pins are stationary, or in shingled stacks on a takeaway conveyor. Several embodiments of the bag machine are disclosed.

26 Claims, 34 Drawing Figures

30
32
33
34
36
38
40
42
44
48
50
52
53
54
56
58
76
78
82
104
106
108
112
120
128
130
166
170
172
174
176
178
186
187
207
208
209
210
211
212
242
244
248
250
260
262
266
268
270
272
274
276
278
281
296
358
357
356
354
359
372
382
384
388
401
402
403
404
405
406
412
418
B
H
W

FIG_5
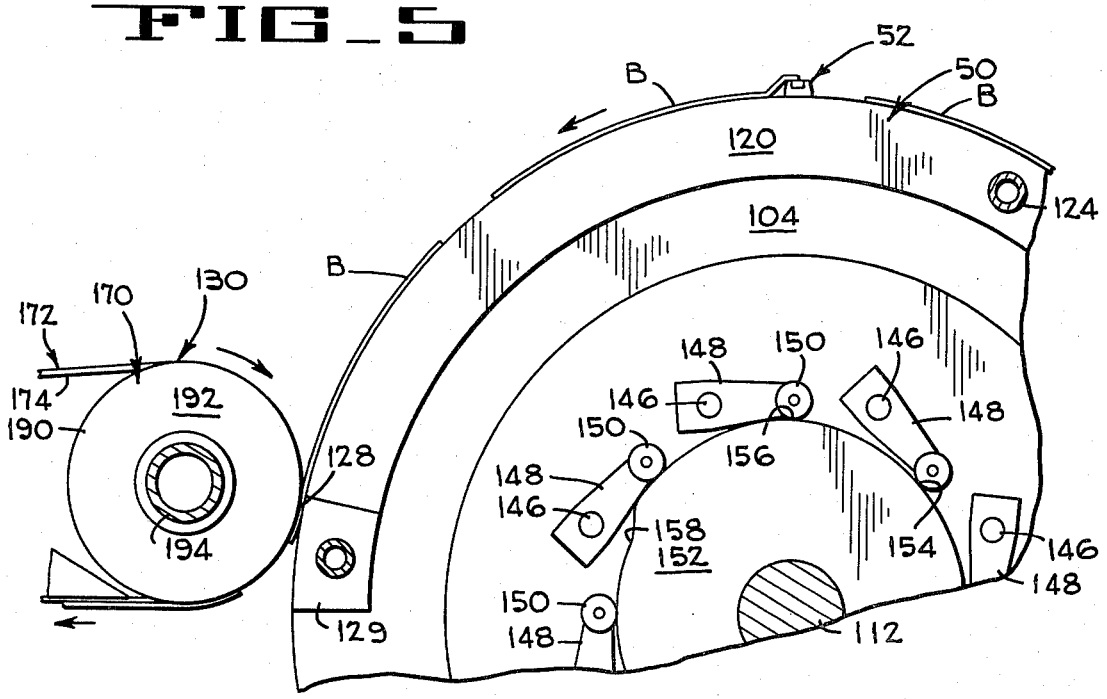
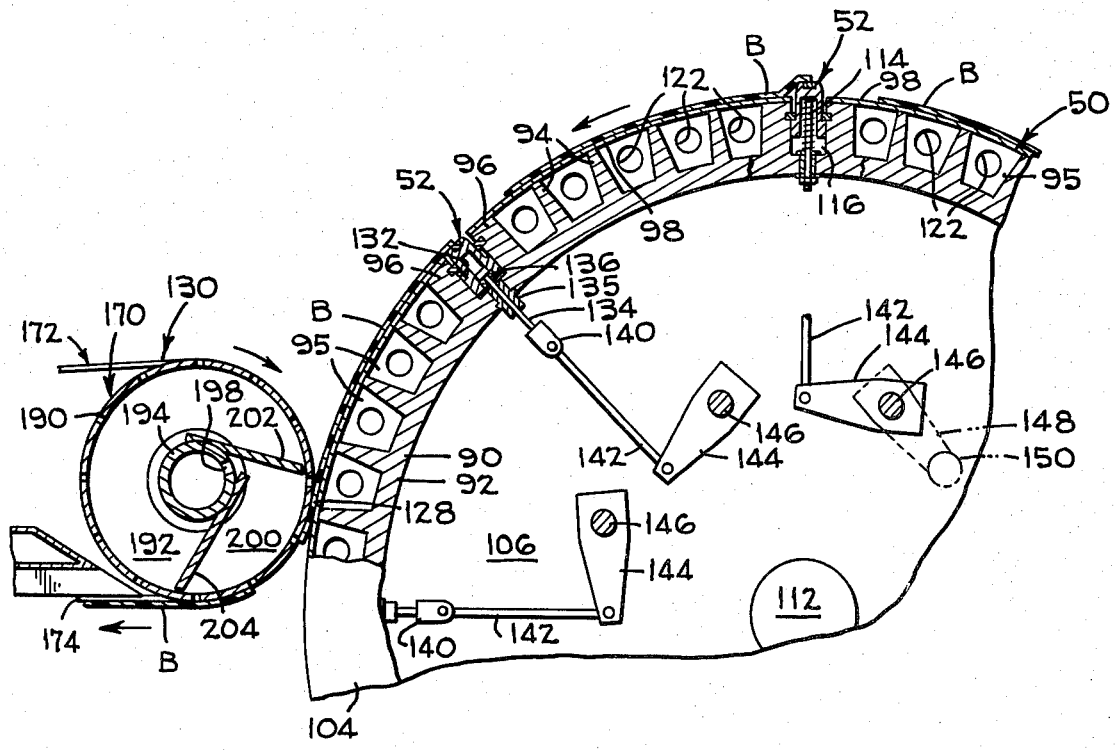
FIG_6

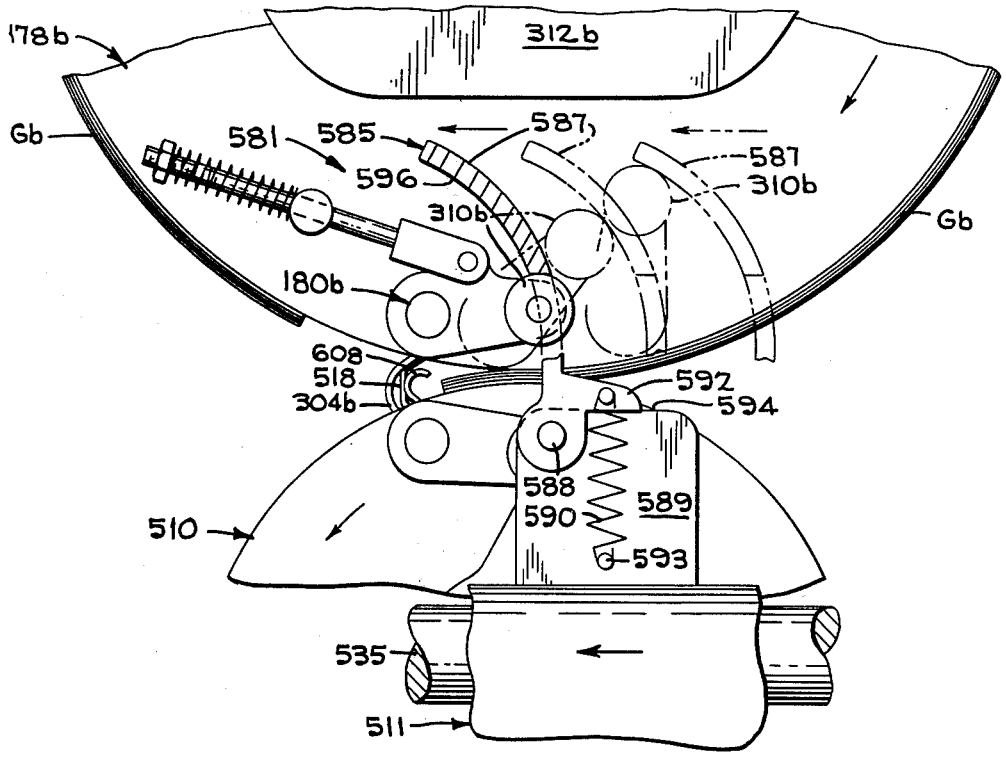
FIG_20
FIG_21
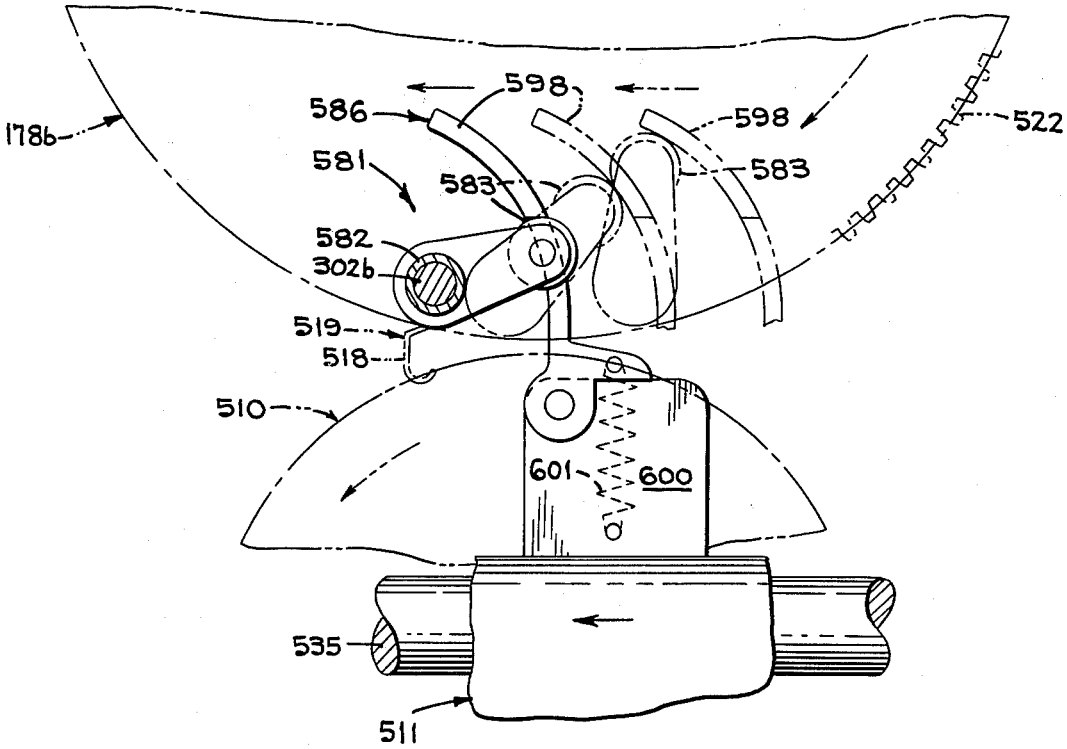

APPARATUS FOR ACCUMULATING ARTICLES SUCH AS BAGS

BACKGROUND OF THE INVENTION

1. Field of the Invention

The present invention relates to method and apparatus for continuously making articles such as bags or the like preferably from a folded double layer web of thermosealing material, and for then accumulating a predetermined number of articles into groups before discharging the groups of articles at a fixed location.

2. Description of the Prior Art

Rotary side weld bag machines which include a large continuously rotating drum are known in the art. United States Van Der Meulen Application Serial No. 539,943 discloses a continuously driven rotary bag machine having a large diameter bag making drum with a plurality of axially extending sealing pads on its periphery. A rotary sealing head having a pair of diametrically opposed heat sealing and severing bars thereon is driven in timed relation with the drum causing the bars to register with the sealing pads having a lightly tensioned folded web of thermosealing material passing therebetween. The sealing bars seal both sides of the bags and sever each bag from the web. The web is drawn from a supply roll advanced through a pair of draw rolls into a loop forming device.

The loop forming device includes a pair of idler rolls, and a vertically reciprocated roll which is moved upwardly against the lightly tensioned web. The stroke of the reciprocating roll is adjustable relative to the idler rolls so as to engage and push the web upwardly a predetermined distance relative to the two idler rolls shortly after each bag is severed from the web. This loop forming device is incorporated because the feed roll surface velocity is always less than the surface velocity of the bag making drum. An appropriate size loop of web is therefore produced and allowed to pay out at a time which will assure that during the sealing period the web velocity and seal pad surface velocity are matched and web tension is minimized.

The web drawing or feed rolls are preferrably driven via an adjustable drive ratio device or by other means permitting change of driving ratio. The drive ratio setting determines how much web will be fed per cycle of the bagmaker and thus establishes the width of the bag that will be produced. This web feeding or bag width adjustment also determines how much the web leading edge will slip rearwardly on the drum surface during each bag making cycle.

The web is maintained on the drum by vacuum, and after the bags have been formed they are blown outwardly from the bag making drum against a plurality of spaced belts which are driven at the same speed as and follow the periphery of the drum. A suction roll and an underlying belt then aid in discharging the completed bags from the prior art machine. No device is disclosed for accumulating and stacking the finished bags. The disclosure of this application is incorporated by reference herein, which application is licensed by the assignee of the present invention.

One important object of the present invention is to accumulate and stack bags in a manner which minimizes air entrapment between bags by pressing or rolling the new bags into accumulating groups and subsequently pressing or rolling the accumulated groups of bags onto a stack receiving device.

Another object of the present invention is to provide a device for accumulating and stacking finished bags which will give time for processing and/or transferring groups of bags without requiring the interruption or slowing of the bag making cycle.

U.S. Pat. No. 3,105,422 Simpson et al which issued on Oct. 1, 1963 and is assigned to the assignee of the present invention discloses a bag stacking mechanism. The bag stacking mechanism includes a rotary accumulating drum which receives bags from spaced belts partially trained around and moving at the same peripheral speed as the drum. The leading edge of a predetermined number of bags enter between the fingers of a movable jaw and a stationary jaw both of which rotate with a drum one revolution for each bag being accumulated. Cam operated means are provided to open and close the movable jaws, and other cam means are provided to clamp the bags to the jaws and to subsequently push the leading edges of the accumulated bags out of the rotary drum. However, the drum includes only one set of clamp jaws and is not reciprocated during the bag accumulating operations as in the present invention.

U.S. Pat. No. 3,431,828 Crawford et al which issued on Mar. 11, 1969 and is assigned to the assignee of the present invention discloses an intermittently driven wicket conveyor of the general type disclosed in the preferred embodiment of the present invention for receiving groups of bags from the accumulating mechanism of the present invention. The disclosure of this Crawford et al patent is incorporated by reference herein.

SUMMARY OF THE INVENTION

In accordance with the present invention the method and apparatus for making and accumulating articles such as bags includes a continuously driven bag making drum, a rotary heat sealing and severing head, a web advancing mechanism, and a bag width adjusting mechanism broadly similar to the above described prior art bag machine. In addition to the above components, the bag making and accumulating machine includes a bag stripping and accumulating mechanism which removes each bag from the bag making drum and accumulates the stripped bags in groups containing a predetermined number of bags (preferably 25 bags per group). The groups of bags are then released from the stripping and accumulating mechanism into a discharge mechanism such as the wickets of a wicket conveyor which may accumulate a plurality of groups of bags (for example 10 groups) on one set of wickets before the wicket conveyor is indexed to present the next set of wickets in the discharge station. Alternately, the discharge mechanism may be a conveyor for receiving shingled groups of bags, or a mechanism which receives a stack composed of a plurality of groups of bags.

In accordance with the present invention the article accumulating mechanism comprises means for continuously moving a row of equally spaced articles along a first predetermined path, means defining at least one rotatable article collecting drum, means defining at least one article clamping unit on said drum, drive means for rotating said drum and also for cyclically moving said drum bodily along a second predetermined path in timed relation with the movement of the articles for moving said clamping unit into position to grip said spaced articles, means for actuating said clamping unit for gripping an article each time said clamping unit moves into position to grip an article from said first path and collect a plurality of gripped articles while rotating and moving through one cycle along said second path, and means for discharging one full group of articles from one clamping unit during each cycle of said collecting drum.

In a first embodiment of the invention the bags are formed on a bag making drum having retractable sealing pads. The pick-off and accumulating mechanism includes an elongated conveying system for stripping the bags from the bag making drum, which transfers the bags to an in-line rotary accumulating drum whose peripheral surface is driven at the same peripheral speed as the bag stripping conveyor. While the accumulating drum is collecting bags while moving from a first path, an accumulator drive mechanism is reciprocating the accumulated drum as a unit along a linear second path past a discharge station in one direction wherein the peripheral speed of the drum is twice the linear speed of the unit, i.e., the periphery of the drum in effect rolls across a stationary surface at the discharge station. With this speed relationship the periphery of the accumulating drum rolls each group of bags, in turn, onto stationary wickets and releases the groups of bags from the accumulating drum in response to movement of the drum in one direction into the discharge station.

In a second embodiment of the invention the bag making drum has non-retractable sealing pads thus requiring a large diameter vacuum drum with equally spaced recesses therein to accommodate the extended sealing pads at the transfer point between the bag making drum and the bag stripping and accumulating mechanism. Except for the larger vacuum drum and an additional transfer conveyor that defines a portion of the first path along which the spaced bags are advanced, the second embodiment is substantially the same as the first embodiment.

A third embodiment of the invention differs from the first embodiment of the invention in that the bag accumulating drum is rotated about a fixed axis and strips the bags directly off the bag making drum while rotating at the same peripheral speed as the bag making drum. Three evenly spaced double clamping units are required on the accumulating drum and have jaws that enter slots in the bag making drum to receive new bags and retain bags already accumulated by the clamping units during the plurality of revolutions needed for bag accumulation. One group of accumulated bags is discharged into a collecting drum which is rotated and reciprocated bodily through one cycle for each group of bags accumulated. The group of bags are discharged from the collecting drum when it is moving away from the bag making drum, by rolling out the bags on wicket pins or the like.

A fourth embodiment of the invention is similar to the first embodiment in that the bag making drum and small vacuum transfer drum are the same as in the first embodiment. The fourth embodiment is also similar to the third embodiment in that the accumulating drum is journaled about a fixed axis and transfers the groups of accumulated bags into a collecting drum which rotates and reciprocates. The direction of the rotation of the accumulating drum and the collecting drum are opposite to that of the third embodiment and accordingly the groups are discharged from the collecting drum when it is moving toward the bag making drum. The fourth embodiment features a pair of elongated vacuum belts between the vacuum drum and the accumulating drum for increasing the time permitted to cool the sealed areas of the bags.

The fifth embodiments of the invention includes a bag making drum similar to the third embodiment with slots in its periphery, and has an accumulating drum which picks bags directly from the bag making drum while rotating at the same peripheral speed and while swinging about the axis of the drum like a pendulum. The accumulating drum includes a plurality of evenly spaced clamping units having single groups of clamping fingers thereon which enter the slots in the periphery of the bag making drum, and rely on a series of driven ribbon belts to hold the accumulated articles in place when the clamps momentarily open to receive new bags. During each cycle of arcuate (pendulum) movement of the accumulating drum, one group of bags is collected and is rolled out onto wicket pins or the like.

Although the several embodiments of the present invention, referred to above and to be described hereinafter, have been related to bag making and bag accumulating apparatus using a folded web of thermosealing material, it will be understood that the apparatus may also be used to make and accumulate other thin flexible sheet-like articles such as single sheets or multiple sheets made from single or multiple ply webs.

BRIEF DESCRIPTION OF THE DRAWINGS

FIG. 5 is a longitudinal section of the bag making drum taken along lines 5—5 of FIG. 4 and illustrating the sealing pad retracting cams and cam followers.

FIG. 6 is a longitudinal section through a portion of the bag making drum and a vacuum bag stripping drum taken along lines 6—6 of FIG. 4.

FIG. 20 is an enlarged operational view illustrating clamp releasing mechanisms on one side of the machine for opening one of the double clamping units on the accumulating drum and opening the clamping unit on the group collecting drum.

FIG. 21 is an enlarged operational view similar to FIG. 20 but illustrating the clamp releasing mechanism on the other side of the machine for opening the other clamping unit at the transfer station between the accumulating drum and the group collecting drum.

DESCRIPTION OF THE PREFERRED EMBODIMENT

Figures 1, 1A:
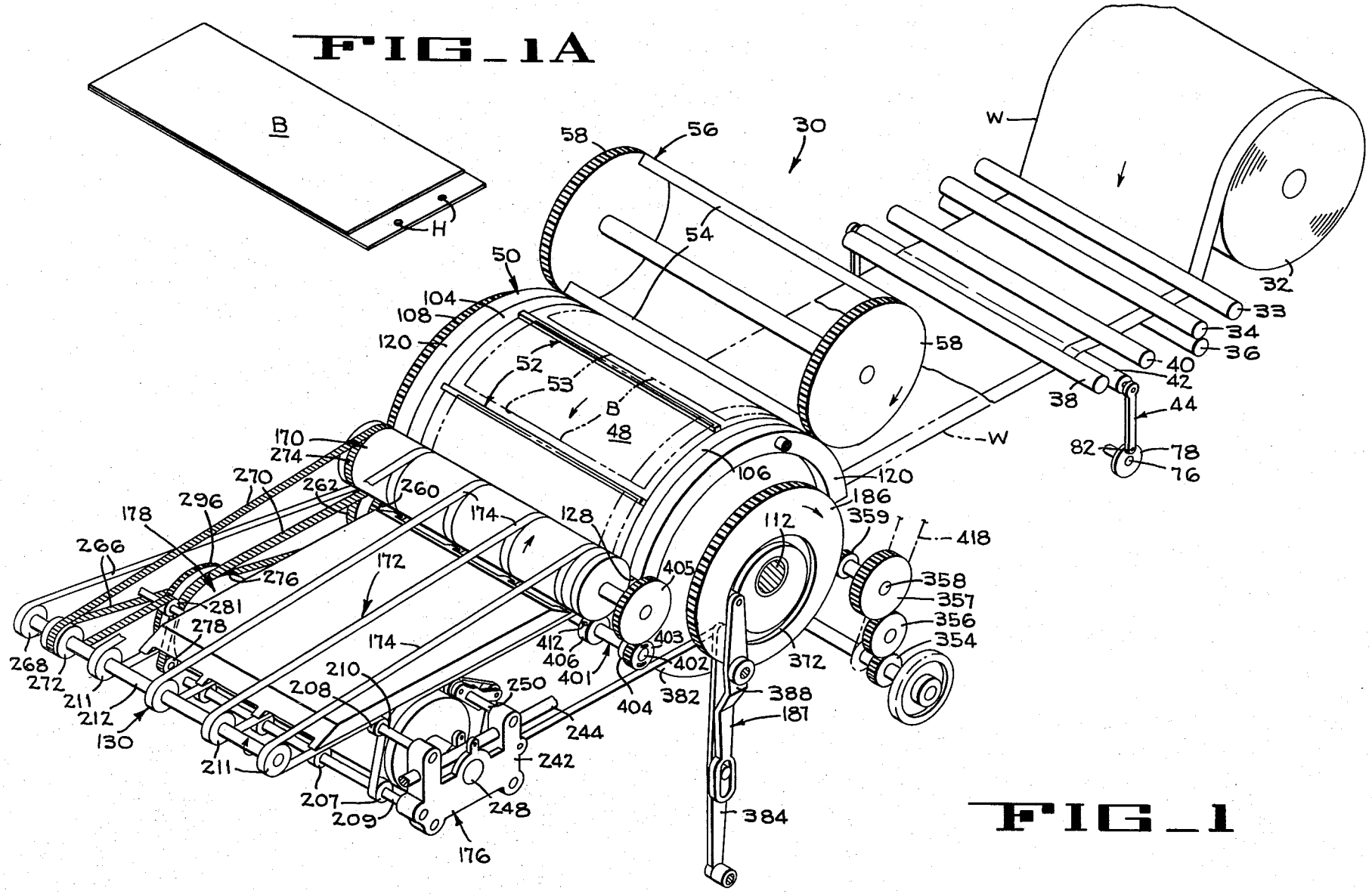
FIG. 1 is a diagrammatic perspective of the operative components of the preferred embodiments of a bag making machine of the present invention, the view being taken looking from the discharge end and left side of the machine.
FIG. 1A is a perspective of a bag made by the machine and having wicket holes in one wall thereof.

The preferred embodiment of the bag making and accumulating machine 30 (FIGS. 1 and 2) receives a longitudinally folded web W of thermosealing film from a supply roll 32. The web W is pulled from the supply roll 32 and under an idler roll 33 by a pair of draw rolls 34, 36 driven at a predetermined speed. The web then passes below two idler rolls 38, 40 and above a vertically reciprocable idler roll 42 of a web loop forming mechanism 44. The web then passes below a direction change idler roll 46 (FIG. 2) for movement around the perforated periphery 48 of a continuously driven rotary bag making drum 50 having a plurality (preferably 8) of transversely extending seal pads 52 thereon. Vacuum is drawn within the web encompassing portion of the drum 50 and cooperates with the draw rolls 34, 36 to hold web W taut. As the web travels over the bag making drum 50, one of a plurality of heated sealing and severing bars 54 presses the web against one of the associated sealing pads 52 thereby severing a bag B (FIG. 1A) of predetermined width from the web while sealing the leading edge 53 of the web and the trailing edge of the bag.

A plurality of the heat sealing and severing bars 54, two being illustrated, are incorporated in a rotary sealing head 56 which preferably has its axis of rotation lying in a plane which is angled about 45° upwardly and rearwardly and contains the axis of the drum 50.

In general the bag making components, and the driving system therefore, operate continuously and rapidly with the intended rate of production for 12″×30″ bags being about 500 bags per minute.

The sealing head 56 is driven at a speed which causes a sealing bar 54 to register with each sealing pad 52. The rotary sealing head 56 includes a pair of gears 58 each rotatably received within three small spur gears 60 (FIGS. 2 and 9) and one large gear 61 journaled on the stationary frame F of the machine 30. The sealing and severing bars 54 are diametrically opposed and include cylindrical end portions 62 (FIGS. 3 and 4) extending through and journaled in the gears 58 near their peripheries. In order to maintain the sealing and severing surfaces of each seal bar directed toward the axis of the drum 50 at all times, a stabilizing rod 64 (FIGS. 3 and 4) is rigidly secured to the end portion of one bar 62 and is slidably received in a guide block 66 pivotally connected to the frame F concentric with the axis of the drum. A similar stabilizing rod and slide block (not shown) are connected to the other bar 54 on the opposite side of the machine 30.

The previously mentioned web loop forming mechanism 44 (FIG. 2) includes a shaft 76 that is driven one revolution for each bag B. Discs 78 are secured to the opposite ends of the shaft 76 and have eccentric pins 82 thereon which are connected to opposite ends of the reciprocable idler roll 42 by links 84. Adjustable brackets 85 support the idler rolls 38, 40 which may be raised or lowered to adjust size of the web loop. The shaft 76 is timed so that the reciprocating roll 42 moves upwardly into engagement with the web shortly after each bag B is sealed and severed thereby withdrawing the sealed leading edge of the web rearwardly a short distance from its sealing pad 52 to lie on the perforated surface of the drum 50. If shorter bags are desired, the drive ratio to the web feeding rolls 34 is adjusted and the adjustable brackets 85 are controlled to lower the rollers 38, 46 so that the leading edge of the web will be withdrawn rearwardly a greater distance during formation of a larger loop for pay out during the sealing period.

As thus far described, the bag machine 30 is similar to the above mentioned Van Der Meulen prior art device except for the position of the sealing and severing head 56, which position provides for additional time for cooling the sealed edges of the bags.

More particularly, the bag making drums 50 (FIGS. 4-6) preferably comprises an aluminum casting 90 having an inner wall 92 integral with a plurality of radially extending spaced ribs 94 (FIG. 6) which define air passages 94 for receiving a vacuum of about three inches of water while the web and bags are in contact with the drum. A plurality of sets of evenly spaced radially extending sealing pad supporting flanges 96 slidably receive the previously referred to sealing pads 52 which will be described in more detail hereinafter. The major portion of the peripheral surface of the drum 50 is formed from a plurality of thin, curved and perforated stainless steel plates 98 which are secured to the flanges 96 as indicated in FIG. 6. End plates or discs 104 and 106 with the disc 106 having a large diameter bull gear 108 secured are journaled on a stationary shaft 112 secured to the frame F.

The sealing surfaces of the several sealing pads 52 are normally urged a short distance upwardly of the periphery of the perforated plates 98 by a plurality of springs 114 (FIGS. 4 and 6) spaced longitudinally of the pads. The springs 114 are received in closed bores in the sealing pads and bear against the closed ends of the associated bores and the bottom of a slot 116 in the drum 50 which slidably receives the associated pad 52. Each pad has a wide inner portion and a narrow outer portion and is held from movement out of the associated slot 116 by resilient bumper strips disposed between flanges on the sealing pad and portions of the clamp bars 102. Each sealing pad 52 also includes a resilient heat resistance strip for engagement by one of the sealing bars 54.

Non-rotatable manifolds 120, (FIGS. 1, 4 and 5) are each provided with an open inner end positioned to slidably engage the adjacent end plate 104, 106. Each end plate is provided with a plurality of holes 122 (FIGS. 4 and 6) that register with each air passage 95. A vacuum source draws vacuum from conduits 124 (FIG. 4) that are connected to the manifolds 120 thereby evacuating those air passages 95 registering with the manifolds. The arcuate extent of the manifolds 120 is best illustrated in FIG. 1 and extends from a point near the entry of the web W onto the drum 50 to a point near a bag stripping or transfer point 128. In order to aid the stripping of the bags B from the drum 50, high pressure air (from a source not shown) is directed into a short high pressure air manifold 129, through the holes 122, into the air passages 95, and out through the perforations in the drum 50 to blow the bags away from the drum onto a bag stripping and accumulating mechanism 130. The bag stripping and accumulating mechanism 130 then controllably removes each bag B in turn from the bag making drum 50.

In the first embodiment of the invention it is necessary to retract the sealing pads 52 within the periphery of the drum 50 prior to moving the pads into the bag strippoing position. Accordingly, each sealing pad 52 is provided with a plurality of slots 132 (FIGS. 4 and 6) at a plurality of positions longitudinally thereof (and spaced transversely from the planes containing the springs 114) to receive the head ends of capscrews 134 which have their threaded shanks projecting inwardly and slidably received in bushings 135 pressed into holes in the inner wall 92 of the drum 50. The head of each capscrew 134 is maintained within the associated slot 132 by an apertured block 136 secured to the sealing pad 52. The threaded end of each capscrew 134 is connected to a yoke 140 pivoted to a link 142 that is in turn pivoted to one end of an associated lever 144. Each lever 144 is clamped to a shaft 146 that is journaled in both end plates 104 and 106. A cam arm 148 (FIGS. 4 and 5) having a cam follower 150 journaled on one end is clamped to a portion of the shaft 146 that extends outwardly of the adjacent plate 106. The cam follower 150 rides along a stationary cam 152 that is secured to the stationary drum shaft 112. The periphery of the cam 152 begins to increase in diameter at point 154 (FIG. 5) thereby engaging the cam follower 150 to gradually retract the associated seal pad 52 until the pad is fully retracted at cam point 156 and remains fully retracted until the associated follower 150 moves past cam point 158. Between cam points 158 and 154, the seal pad 52 is moved to its extended position by the springs 114 with the cam follower 150 either spaced from or in minimal contact with the cam surface.

An important feature of the invention is the provision of apparatus, and a method of operating the same, which is capable of accurately and reliably stripping single bags from the bag making drum 50 and collecting the bags in groups G (FIGS. 7, 10 and 13) of predetermined numbers (preferably 25) before depositing the groups of bags on wicket pins P or on a take-away conveyor in shingle groups, independent groups, or several groups forming a stack.

Figure 13:
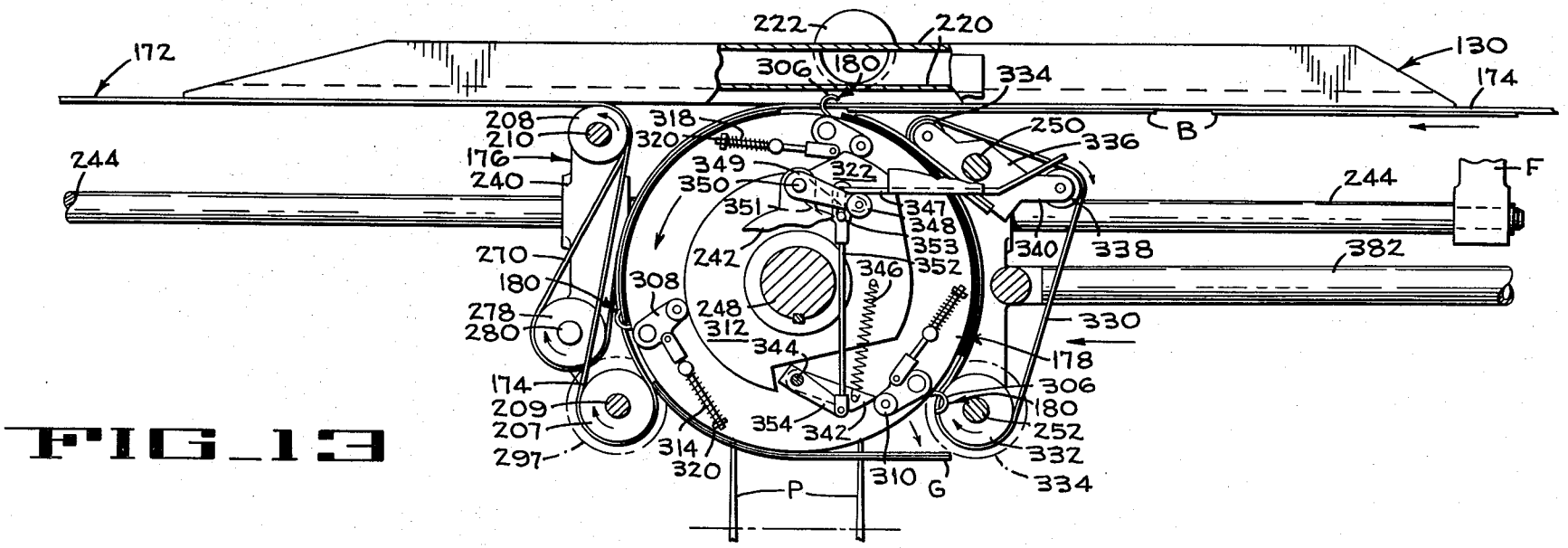
FIG. 13 is an operational view illustrating one of the clamping units being opened at the discharge station for discharging a group of bags onto a pair of wicket pins.

In the preferred embodiment of the invention the bag stripping and accumulating mechanism 130 (FIGS. 1, 2 and 7-13) includes a rotary vacuum drum 170 which, with the aid of high pressure air from the manifold 129 (FIG. 3), strips the bags B from the bag making drum 50. The vacuum drum 170 forms one end of an elongated transport vacuum conveyor 172 (FIGS. 1 and 2) which includes a plurality of spaced transport or ribbon belts 174. The transport conveyor 172 moves spaced bags along a linear path above a reciprocating bag accumulating carriage 176 which includes a rotary bag collecting or accumulating drum 178 having a plurality of bag clamping units 180 thereon. The rate of rotation of the accumulating drum 178 and the rate of reciprocation of the carriage 176 is designed so that the clamping units 180 will progressively remove one bag at a time from the vacuum conveyor 172 and will accumulate the predetermined number or groups of bags under each clamping unit 180 before releasing each group of bags on wicket pins P or the like. After the first two cycles of the carriage 176, each following carriage cycle will load the predetermined number of bags required to form a group G under each clamping unit, and will release one group of bags per carriage cycle onto the stationary wicket pins P by rolling the group of bags onto the pins at a discharge station DS as best illustrated in FIG. 13.

In the illustrated first embodiment, which embodiment is designed to handle bags at the rate of about 500 bags per minute, each bag is 12 inches wide and the bag making drum includes 8 sealing pads 52. The peripheral speed of the bag making drum 50 the rotary vacuum drum 170, and the linear speed of the vacuum conveyor 172 are identical. Three equally spaced clamping units 180 are mounted on the accumulating drum 178, and 25 bags are accumulated in each group G as indicated above.

Figure 2:
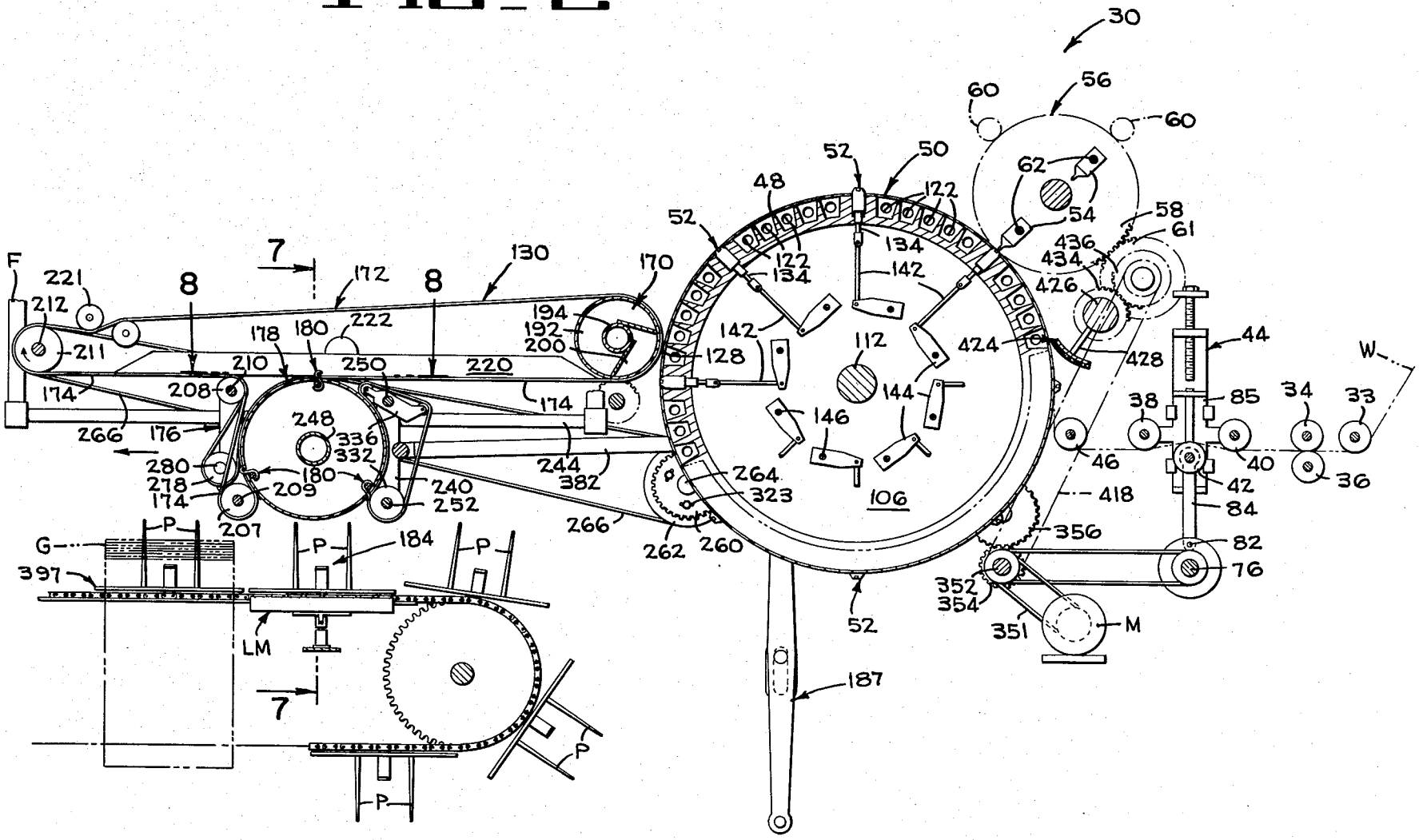
FIG. 2 is a diagrammatic vertical longitudinal section of the operative components of the apparatus of FIG. 1, the major portion of the frame being omitted.

The carriage 176 is reciprocated by means of a pair of cam-gears 186 (only one being illustrated in FIGS. 1, 3 and 9) journaled on opposite end portions of the shaft 112 of the bag making drum 50. As will be described in more detail later, the cam-gears 186 operate identical linkage systems 187 for reciprocation of the carriage 176. The cam-gears are driven one revolution while the bag making drum rotates 3⅛th revolution to provide the requisite 25 bags per cycle at the carriage 176. It will be appreciated that the peripheral speed of the accumulating drum 178 is critical when it is discharging bags, i.e., when it moves past the discharge station DS toward the left (FIGS. 2 and 13). The requisite discharge speed of the collecting or accumulating drum 178 is equal to the speed of the drum if it was rolling along the stationary surface at the discharge station.

More particularly, the bag stripping and collecting mechanism 130 comprises the vacuum drum 170 (FIGS. 2 and 6) which includes a perforated cylinder 190 secured to circular end plates 192 journaled on a stationary tubular shaft 194 secured to the frame F and having one end closed. A vacuum supply conduit is connected to the tubular shaft 194, which shaft is provided with a plurality of holes 198 leading into a vacuum chamber 200 defined by a pair of elongated plates 202 and 204 rigidly secured to the shaft 194 and terminating closely adjacent the inner surface of the perforated cylinder 190 and the end plates 192.

The vacuum conveyor 172 comprises the plurality of spaced endless transport or ribbon vacuum belts 174 (FIGS. 1, 2 and 7–10) that are about 1 inch wide and 0.050 inches thick and are perforated to permit air to be evacuated therethrough. The spaced belts 174 are trained around the vacuum drum 170, around a portion of the accumulating drum 178, around idler pulleys 207 and 208 keyed on shafts 209 and 210 journaled in the carriage 176, and around drive pulleys 211 secured to a shaft 212 journaled on the frame F. The belts 174 also move below vacuum openings 218 (FIG. 7) in a stationary elongated vacuum chamber 220 which draws vacuum upwardly through the belts 174. The belts are also tensioned by idler pulleys 221 (only shown in FIG. 2).

Figure 7:
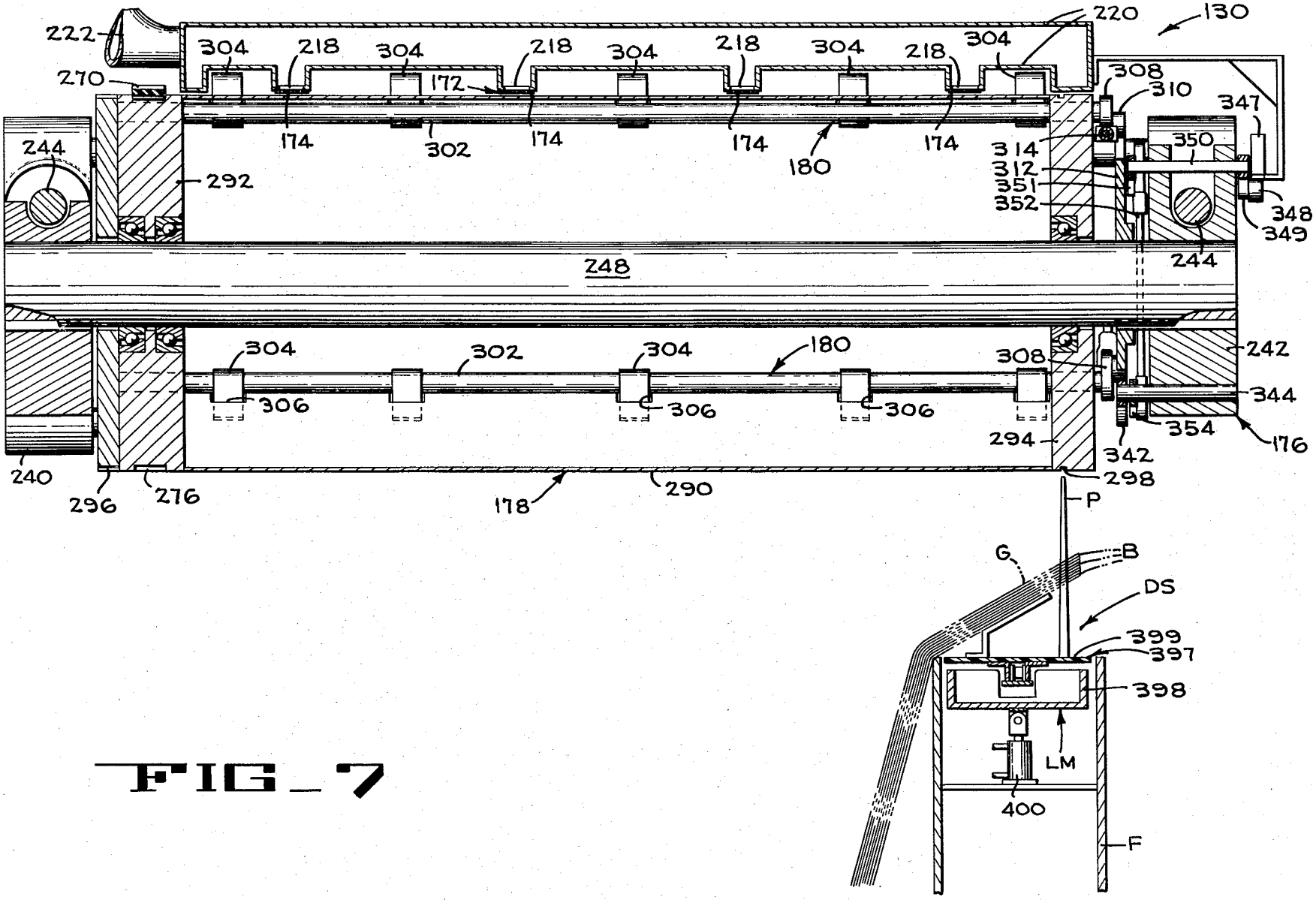
FIG. 7 is an enlarged vertical transverse section taken along lines 7—7 of FIG. 2 illustrating the bag accumulating drum and a fragment of the wicket conveyor having a group of bags thereon.
Figure 8:
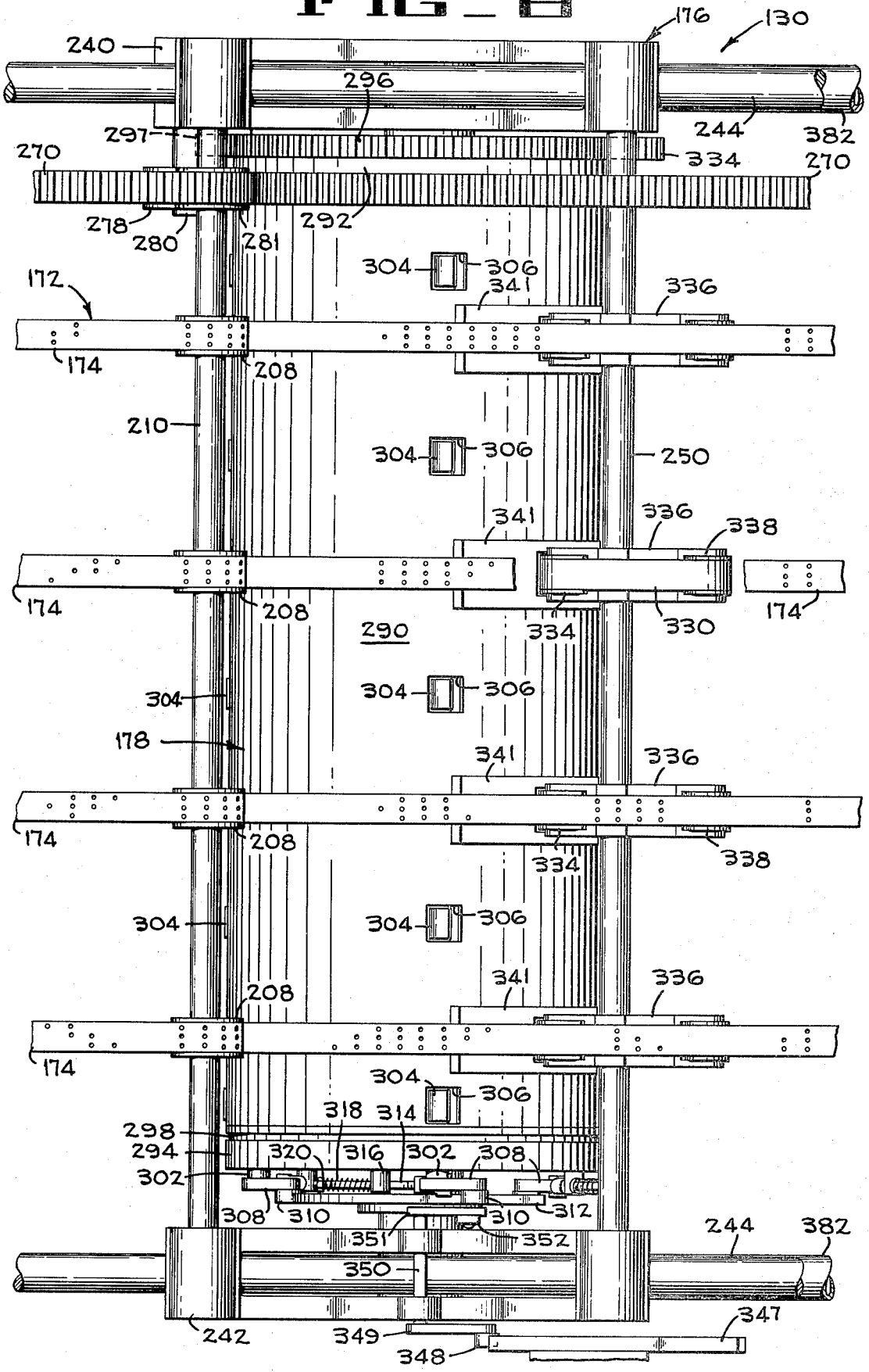
FIG. 8 is an enlarged horizontal section taken along lines 8—8 of FIG. 2 looking down on the accumulating drum.

The vacuum chamber 220 is connected to a source of vacuum (not shown) by a conduit 222. Thus, the vacuum drum 170 with the aid of high pressure air from the manifold 129 (FIG. 3) strips spaced bags B one at a time from the bag making drum 50; and the vacuum conveyor 172 maintains the bag spacing and moves the bags to the left (FIG. 2) until they are engaged by associated clamping units 180 and are pulled free from the vacuum conveyor 172 at any one of a plurality of locations along the lower surface of the vacuum conveyor 172 as will be described. In order to accommodate the clamping units 180 between the several ribbon belts 174, the area of the bottom wall of the vacuum chamber 220 between the belts is relieved as indicated in FIG. 7 to permit the clamps 180 to open and close while moving therethrough.

The drum supporting portion of the carriage 176 comprises a pair of end brackets 240, 242 on opposite sides of the machine 30 that are slidably received on rods 244 secured to the frame F. The two end brackets 240, 242 are interconnected by the shafts 209, 210, (FIG. 10) a non-rotatable drum shaft 248, a non-rotatable rod 250, and a rotatable shaft 252 journaled in the end brackets 240, 242.

Figure 9:
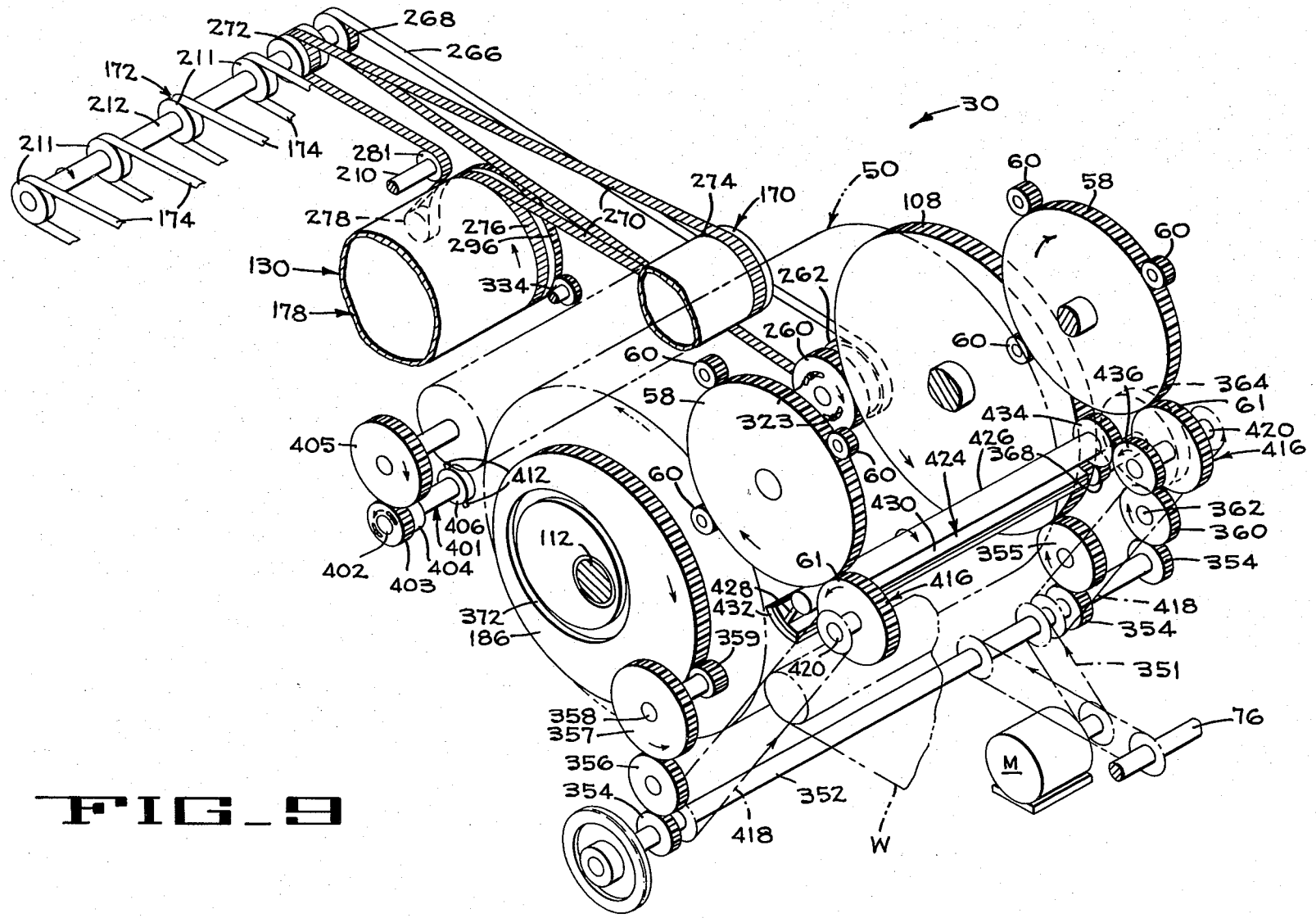
FIG. 9. is a perspective illustrating the drive system for the apparatus of FIG. 1.

In order to drive the rotary components of the bag stripping and collecting mechanism 130 in timed relation with the bag making drum 50, the rotary components are driven from the bull gear 108 (FIG. 9). The bull gear 108 meshes with a pinion 260 attached to a toothed cog belt pulley 262 and secured to a stub shaft 264 journaled on the frame F. An endless toothed cog belt 266 (FIGS. 1 and 2) is trained around the pulley 262 and another cog belt pulley 268 that is secured to the shaft 212. A double-sided cog belt 270 is trained around cog belt pulleys 272, 274, 276, 278 secured to the conveyor drive shaft 212, the vacuum drum 170, the accumulating drum 178, and an idler shaft 280 secured to the reciprocating bag accumulating carriage 176, respectively. The ratios of the several gears and the toothed cog belt pulleys are such that the peripheral speed of the bag making drum 50, the vacuum drum 170, and the perforated belts 174 of the vacuum conveyor 172 are identical.

Although the peripheral speed of the accumulating drum 178 is the same as that of the vacuum belts 174, since the drum 178 is in rolling contact with these belts and with the double cog belt 270, it will be appreciated that the additional reciprocal motion imparted to the accumulating drum 178 will cause the peripheral speed of the drum to be slow when moving toward the left (FIG. 2) and to be much faster when moving toward the right in FIG. 2.

The accumulating drum 178 comprises a cylinder 290 (FIGS. 7 and 8) secured to rotary end plates 292, 294 journaled on the non-rotatable shaft 248. The cog belt pulley 276 and a gear 296 are secured to one end plate 292 and each have a pitch diameter equal to the outside diameter of the drum 178. In order to assure proper driving of the vacuum belts 174, a spur gear 297 (FIG. 10) is keyed to the shaft 209 and meshes with the gear 296 secured to the accumulating drum 178. An annular groove 298 (FIG. 7) is formed in the end plate 294 near one end of the drum to receive wicket pins P in the event the groups of bags are to be discharged onto such pins P.

Figure 10:
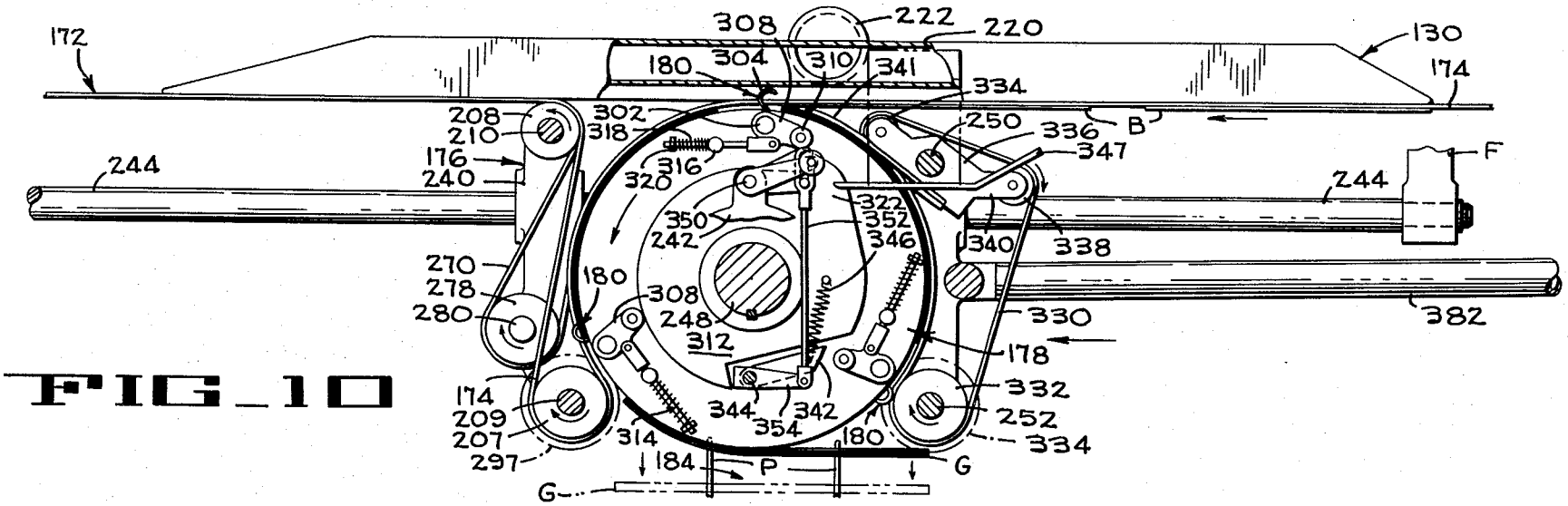
FIG. 10 is an enlarged operational view in longitudinal section illustrating the accumulating drum at approximately the midpoint along its linear travel, one of the clamping units being open and tangent to the bag transporting ribbon conveyor immediately before it clamps an incoming bag to the already accumulated bags.
Figure 11:
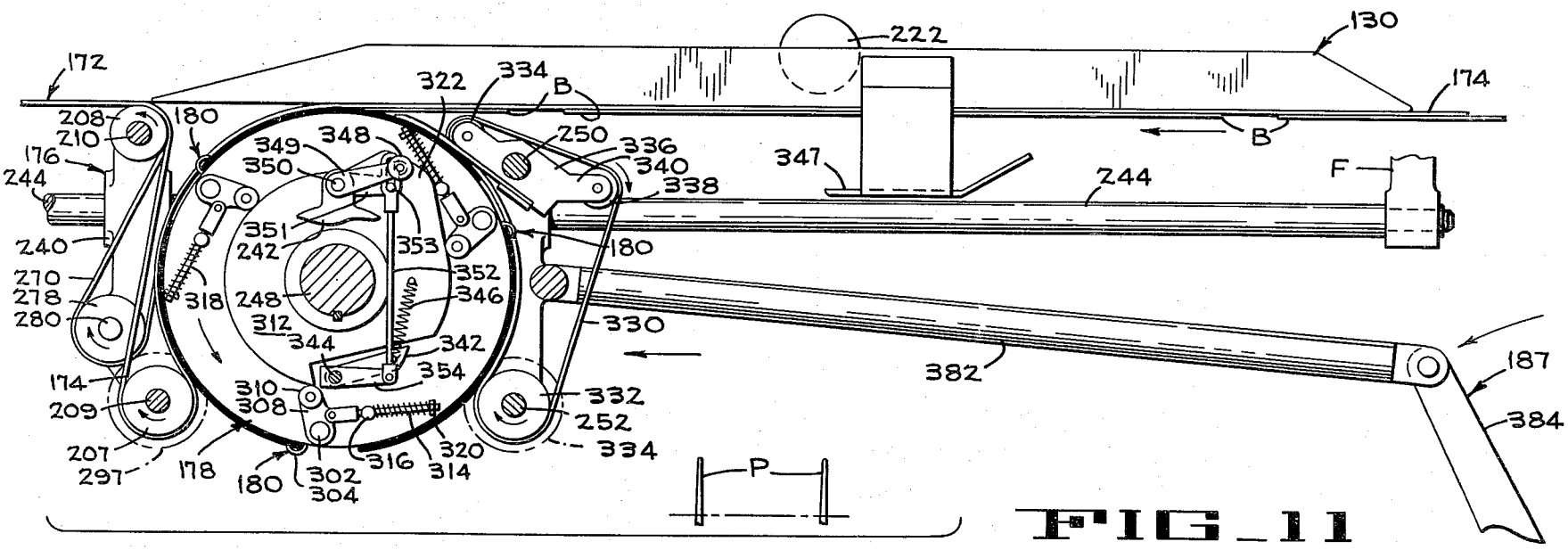
FIG. 11 is an operational view similar to FIG. 10 but with the accumulating drum at the downstream end of its reciprocable path of movement.
Figure 12:
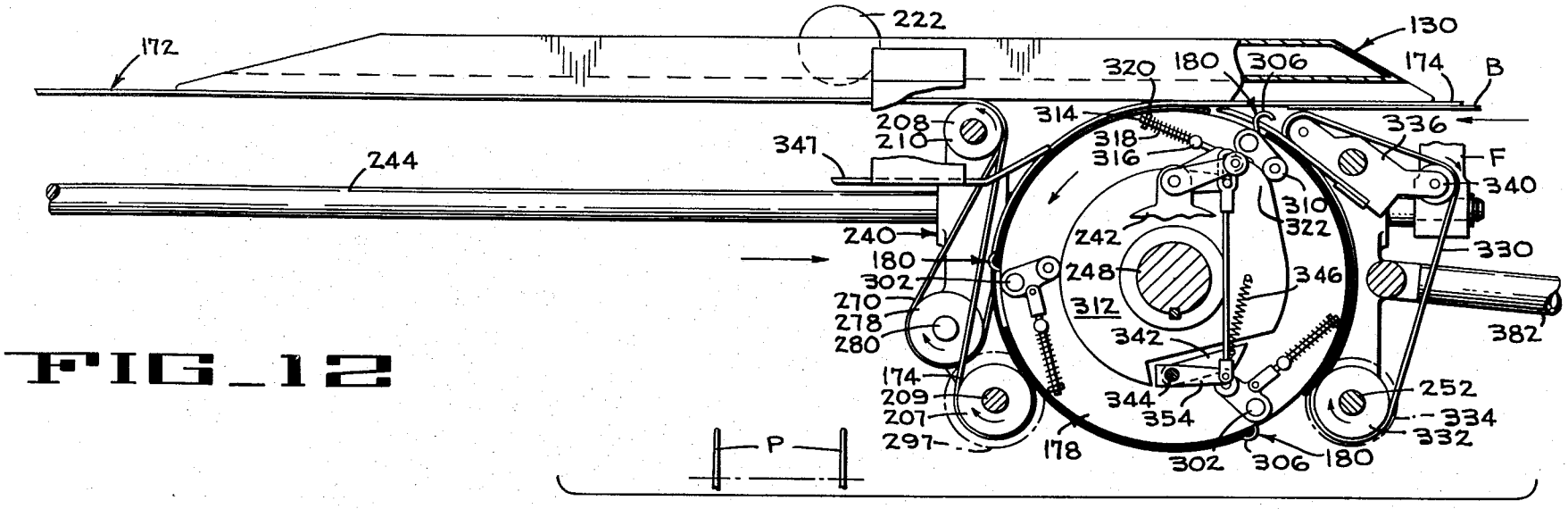
FIG. 12 is an operational view similar to FIG. 11 but illustrating the accumulating drum at the other end of its stroke.

The three bag clamping units 180 (FIGS. 7, 8 and 10) are spaced at even integrals around the accumulating drum 178 for rotation therewith. Each clamping unit 180 includes a bag clamping shaft 302 journaled in the end plates 292,294. Each shaft has a plurality of spring steel bag holding clamps 304 secured thereto, which clamps project through openings 306 in the cylinder 290 at points between the belts 174 as previously mentioned. A lever arm 308 is secured to one end of each shaft 302 and has a cam follower 310 journaled thereon in position to ride over the peripheral surface of a non-rotatable cam 312 secured to the stationary shaft 248. A spring guide arm 314 is pivotally connected to each lever arm 308 as best shown in FIG. 10 and extends through an aperture in an abutment member 316 secured to the adjacent end plate 294 for rotation therewith. A compression spring 318 on each arm is disposed between the abutment member and a nut 320 screwed on the spring guide arm 308 to urge the clamps 304 toward their bag clamping positions with sufficient force to reliably clamp the bags as they are being accumulated between the spring steel clamps and the periphery of the drum 178.

The contour of the cam 312 is such that a non-rotatable lobe 322 (FIGS. 10–13) pivots each shaft 302 to open the clamping units 180 shortly before the clamping units become tangent to the belts 174. It will be understood that the position of the clamping units are set before operation commences so that the clamping units 180 will engage and clamp the leading edge of the incoming bags on the belts 174 approximately as the clamping units 180 move past the tangent point at which time the cam followers move off the lobe 322 to close the units upon the incoming bags and the accumulated bags thereunder. The preset points at which the clamping units 180 become tangent to the belts 174 so as to engage the leading edges of bags of different widths are located by adjusting the pinion gear 260 (FIGS. 2 and 3) relative to the cog belt pulley 262 by means of capscrews and arcuate slot connectors 323.

It will be appreciated that the clamping units 180 momentarily release the accumulated bags but that the incoming bag is held tightly between the belts 174 and the periphery of the drum 178 since the belts are trained around the drum for approximately 135° from the transfer point.

Since the forward end of the accumulated bags are momentarily released as they approach the tangent point, a plurality of transversely spaced ribbon belts 330 (FIG. 10) are trained around the rear portion of the accumulating drum 178, around pulleys 332 secured to the shaft 252, around small diameter nose rolls 334 journaled on brackets 336 secured to the rod 250, and around take-up rolls 338 journaled on arms 340 pivoted to the brackets 336 for belt tensioning adjustment by means not shown. The ribbon belts 330 are driven at the same speed as the peripheral speed of the accumulating drum 178 by a spur gear 334 keyed to the shaft 252 and meshing with the accumulating drum gear 296. Arcuate spring steel plates 341 (FIGS. 8 and 10) are connected to each bracket 336 and extend forward of the nose roller 334 to achieve further control of the accumulated bags.

In order to release one group of bags per each reciprocable cycle of the carriage 176, a cam gate 342 is secured to a shaft 344 pivoted to the lower portion of the cam 312 and is moved from the inactive position shown in FIG. 10 to the bag group releasing position illustrated in FIG. 13. The gate 342 is normally held in its inactive position by a spring 346 connected between the gate and the cam 312. The gate 342 is lowered into discharge position by the beveled end of a stationary cam plate 347 secured to the stationary frame F each time the carriage 176 moves therepast toward the left (FIG. 13) by engagement of a cam follower 348 with the cam plate 347. The cam follower 348 is journaled on an arm 349 that is pivoted to the end bracket 242 (FIG. 8) of the carriage 176 by a shaft 350, which shaft has a second crank arm 351 secured thereto. A link 352 is connected to the crank arm 351 by a lost motion slot and pin connector 353 while the other end of the link 352 is pivoted to a lever 354 that is rigidly secured to the pivot shaft 344 of the gate 342. The lost motion connector 353 permits the cam follower 348 to move over the stationary cam plate 347 toward the right (FIG. 12) without affecting the gate 342.

The power for reciprocating the collector drum 178 and carriage 176 and for driving the bag making drum 50 along with the above described bag collecting components originates at a motor M (FIG. 9). A chain drive 351 connects the output shaft of the motor to a handwheel shaft 352 which is driven one revolution per bag, is journaled in the frame F, and extends the full width of the machine 30. Three spur gears 354 are keyed to the shaft 352. One spur gear 354 meshes with an idler gear 355 which is journaled to the frame F near the right side of the machine and meshes with the bull gear 108 to drive the bag making drum 50. Another one of the spur gears 354 meshes with a a gear 356 journaled on the frame which meshes with a large gear 357 keyed to a stub shaft 358 journaled on the frame F and driving a small gear 359 that meshes with and drives the left cam-gear 186.

Similarly, the other spur gear 354 meshes with a speed reducing gear 360 keyed to a stub shaft 362 journaled on the frame F near the right side of the machine. The gear 360 engages a large gear 364 (shown in phantom lines) secured to a stub shaft (not shown) journaled on the frame F and having a small gear 368 keyed thereto and meshing with the right cam-gear (not shown but identical to left cam-gear 186) to drive the same at the same speed as the right cam-gear. The cam-gears each have a cam track 372 formed therein and are journaled on the stationary bag making drum shaft 112.

As mentioned previously, the gear ratios of the several gears in the above defined gear train of the preferred embodiment of the bag making machine as illustrated in FIGS. 1–13, drives the bag making drum 3 and $\frac{1}{8}$ revolutions while driving the cam-gear one revolution for each 25 revolutions of the hand wheel shaft 352.

In order to reciprocate the accumulating drum 178 (FIG. 2) and carriage 176, identical linkage mechanisms 187 (only the left linkage being shown in FIGS. 3 and 4) on each side of the machine are operated by the cam tracks 372 of the cam-gears 370 for reciprocating the accumulating drum 178 and its carriage 176 through one complete cycle for each revolution of the cam-gears 370. Each linkage mechanism 187 includes a connecting rod 382 pivotally connected between the carriage 176 and one end of a first lever 384 pivoted to the frame F at 386. A second lever 388 has a slotted end portion 390 formed on one end which slidably engages a pivot pin 392 connected to the first lever at a point intermediate of its ends. The second lever is pivoted to the frame intermediate its ends by a pin 394 and has a cam follower 396 on its other end which rides in the cam track 372 of the associated cam-gear 370 to reciprocate the accumulating carriage 176 and drum 178.

Figure 3:
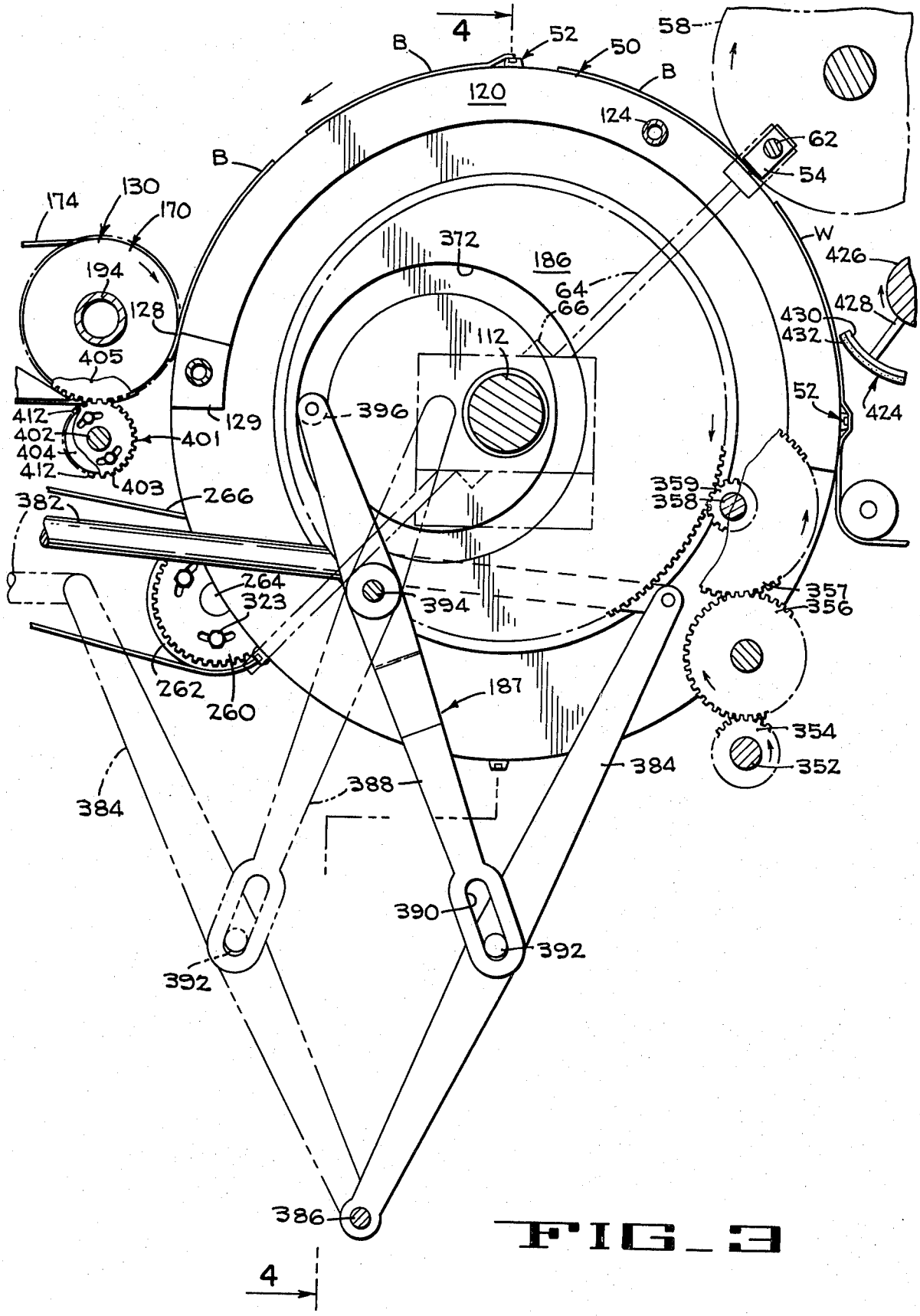
FIG. 3 is an enlarged diagrammatic vertical section of the bag making drum and associated components taken substantially along lines 3—3 of FIG. 4 and illustrating an accumulator reciprocating linkage in two operative positions, certain parts being cut away and others shown in phantom.
Figure 4:
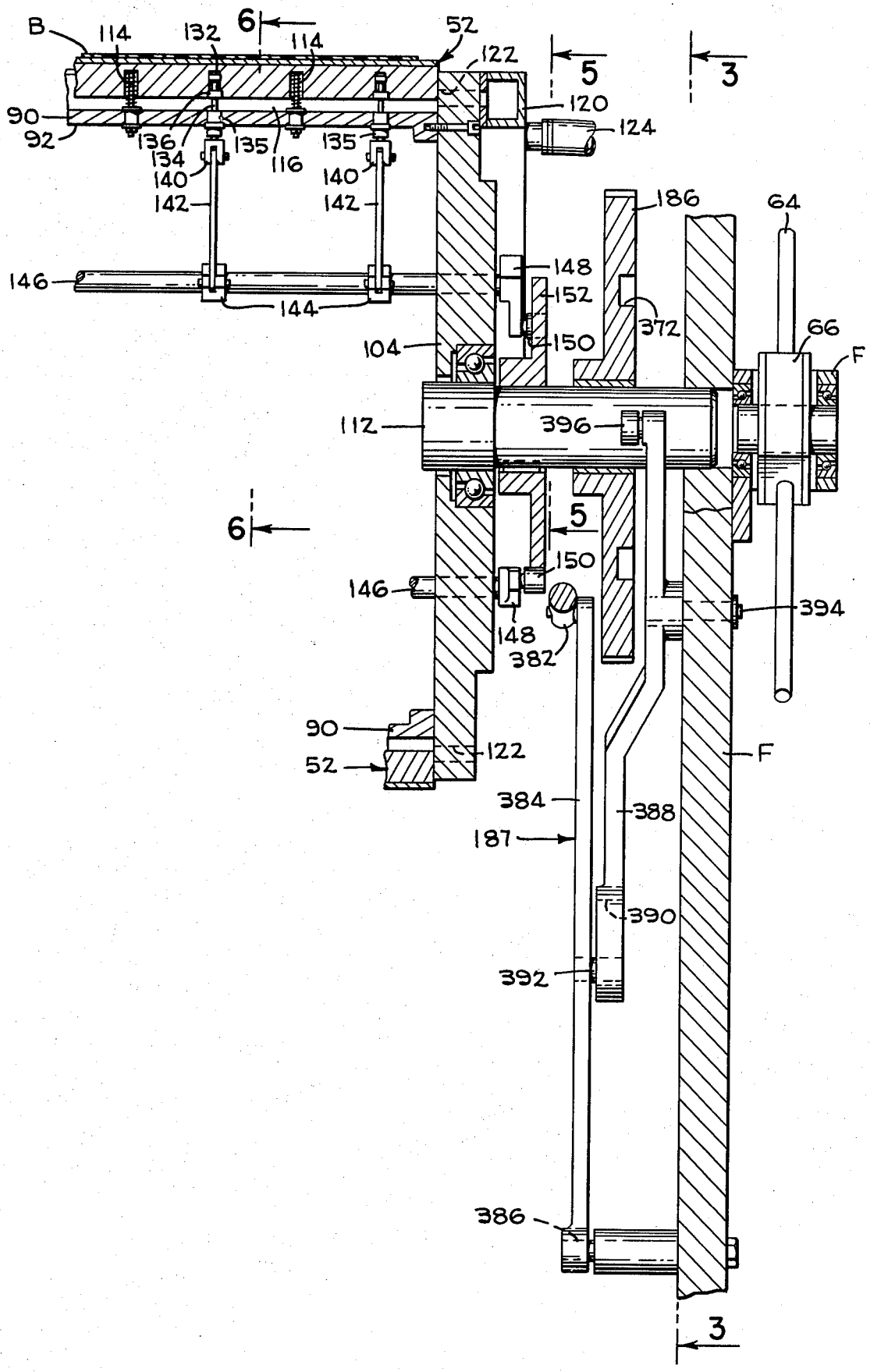
FIG. 4 is a transverse vertical section of a portion of a left side of the bag making drum and associated parts taken along lines 4—4 of FIG. 3.

It will be appreciated that the contour of the cam tracks 372 in the cam-gears 370 are illustrated diagrammatically in FIG. 3, but that the actual cam contour will be such that the accumulated groups G of bags will be rolled out on wicket pins P (FIGS. 2 and 13) or the like at the discharge station DS without imparting any relative horizontal linear movement between the bags and the wicket pins P.

In the preferred embodiment, groups G of bags are illustrated as being discharge onto wicket pins P (FIGS. 7 and 13) when the pins are stationary. It will be understood that any well known type of intermittently driven wicket conveyor 397 may be used such as the wicket conveyor disclosed in U.S. Pat. No. 3,432,828 Crawford et al. which issued on Mar. 11, 1969. The only additional requirement to the standard wicket conveyor is that means be provided to lift the pair of wicket pins P at the discharge station DS upwardly into the prepunched holes H (FIG. 1A) in the bag B, and into the groove 298 (FIG. 7) after the holes and pins P have become aligned. Suitable lift mechanism LM for lifting the pins P is illustrated in FIG. 7, and includes a generally rectangular table 398 that is raised to lift the particular conveyor link 399, and pins upon which the bags are to be discharged. Each time a group of bags B is to be discharged, an air cylinder 400 is activated to raise the pins from the illustrated inactive position.

Although wicket pin holes may be punched in each bag by conventional means, a convenient location for a wicket hole punching device 401 (FIGS. 1, 3 and 9) is disposed directly below the vacuum drum 170.

The hole punch 401 comprises a shaft 402 journaled in the frame F and having a gear 403 journaled thereon but adjustably connected to a disc 404 keyed to the shaft 402 by cap screw and slot connectors for assuring proper location of the holes H for bags of different widths. The gear 403 is driven by a gear 405 secured to the vacuum drum 170 and drives the shaft 402 eight complete revolutions for each revolution of the bag making drum 50. Although the gear 405 is shown spaced from the end of the vacuum drum 170 in FIGS. 7 and 9 for a clearer showing of the hole punch 401, it will be understood that the gear 405 is secured to the end of the drum 170.

A disc 406 is rigidly secured to the shaft 402 and has a pair of radially extending hardened tubular hole punches 412 (FIG. 9) spaced a desired distance apart (about 5 inches) to provide the wicket holes in each bag. The punches 412 are backed by a hardened ring on the vacuum drum 170. The screw and slot connection permits arcuate adjustment of the disc so as to position the wicket holes the same distance apart from the longitudinal centerline of each bag regardless of changes in bag width.

The previously mentioned rotary sealing head 56 which includes two sealing bars 54 is driven four revolutions for each revolution of the bag making drum 50 by two identical drive systems 416 (FIG. 9) disposed on opposite sides of the machine 30. Each drive system 416 comprises a one to one ratio chain drive 418 from the hand wheel shaft 352 to a stub shaft 420 journaled in the frame F. The previously mentioned large gears 61 are keyed to the stub shaft 420, and the gear ratio between the gear 61 and the associated head supporting gear 58 is such that the sealing head 56 is rotated four revolutions for each revolution of the bag making drum 50.

A web snubbing bar 424 (FIGS. 2, 3 and 9) is also provided for engaging the leading portion of the web W shortly after the bag is severed therefrom. The snubber comprises a shaft 428 secured thereto and to an arcuate plate 430 having a resilient pad 432 bonded thereto. The shaft 426 is driven two revolutions for each revolution of the sealing head 56 by a pair of meshing gears 434 and 436 keyed to the shaft 426 and the stub shaft 420, respectively.

Although the operation of the first embodiment of the invention has been described along with a description of the components of the machine, a brief resume of the operation will follow.

The longitudinally folded thermosealing web W (FIGS. 1 and 2) is trained through the bag width adjustment mechanism 44 and around the upper portion of the bag making drum 50 which is adjusted to tension the web and to provide bags B (FIG. 1A) of desired width. Vacuum is applied within the drum to cause the web and bags severed therefrom to cling to the drum. The bag width adjustment mechanism 44 is adjusted as described in the above mentioned Van Der Meulen application Ser. No. 539,943 to provide bags of desired width and to maintain the web properly tensioned. As the web moves between the sealing pads 52 and the heated sealing bars 54, the leading edges and trailing edges of the bags are sealed, each bag is severed from the web, and the leading edge of the web is slidably moved rearwardly from its sealing pad 52 by the bag width adjustment mechanism 44 to provide the proper bag width and spacing between bags. During withdrawal of the web W, the snubbing bar 424 engages the web to aid pulling it firmly and maintaining it wrinkle free and snug against the bag making drum 50.

The evenly spaced bags then move along a first predetermined path, which path is defined by a portion of the bag making drum 50, the rotary vacuum drum 170, and the transport vacuum conveyor 172 of the bag stripping and accumulating or collecting mechanism 130. While the spaced bags B are moved along a linear portion of the first path by the spaced ribbon belts 174 of the vacuum conveyor 172, the several bag clamping units 180 of the rotary collecting or accumulating drum 178 grip and remove each bag in turn from the belts and thereafter accumulate a predetermined number (preferably 25) of bags in each group.

In this regard, the accumulating drum 178 is rotated about its axis and at the same time is reciprocated forwardly and rearwardly relative to the bag making drum 50 one cycle for each $3\frac{1}{8}$ revolutions of the bag making drum thus collecting 25 bags per cycle. The peripheral speed of the accumulating drum 178 is always at the same speed as the bag transporting ribbon belt 174 and in effect, the drum rolls along the linear portion of the belt 174 with the rate of rotation of the accumulating drum being relatively slow when moving away from the bag making drum 50 and being much faster when moving toward the bag making drum.

In the illustrated preferred embodiment, the accumulating drum 178 includes three equally spaced clamping units 180. Assuming that no bags have yet been received by the accumulating drum it will be recognized that during the first two cycles of the drum 178 less than 25 bags will be accumulated in each clamping unit 180 per cycle, and that single bags will be stripped from the linear portion of the first path when the accumulating drum 178 is moving away from the bag making drum 50 and also when the accumulating drum 178 is moving toward the bag making drum 50. The following chart illustrates the manner in which the bags are accumulated and released during the first six cycles after starting the machine 30.

BAGS ACCUMULATED BY AND RELEASED FROM EACH CLAMP PER ACCUMULATING DRUM CYCLE

| | Clamp #1 | | Clamp #2 | | Clamp #3 | | Total |
|---|---|---|---|---|---|---|---|
| Cycles | Acc. | Rel. | Acc. | Rel. | Acc. | Rel. | Accumulated |
| 1st | 9 | All | 8 | 0 | 8 | 0 | 25 |
| 2nd | 8 | 0 | 17 | All | 16 | 0 | 25 |
| 3rd | 16 | 0 | 8 | 0 | 25 | All | 25 |
| 4th | 25 | All | 16 | 0 | 8 | 0 | 25 |
| 5th | 8 | 0 | 25 | All | 16 | 0 | 25 |

-continued

BAGS ACCUMULATED BY AND RELEASED FROM EACH CLAMP PER ACCUMULATING DRUM CYCLE

| | Clamp #1 | | Clamp #2 | | Clamp #3 | | Total |
|---|---|---|---|---|---|---|---|
| Cycles | Acc. | Rel. | Acc. | Rel. | Acc. | Rel. | Accumulated |
| 6th | 16 | 0 | 8 | 0 | 25 | All | 25 |

The above chart indicates that during each complete reciprocating cycle of the accumulating drum 178 that one clamping unit 180 collects nine bags while the other two clamping units each collect eight bags. It will also be apparent that clamps 1, 2 and 3 sequentially pick off bags 1, 2 and 3 from the ribbon belts 174; and that during the first, second and third cycles, clamps 1, 2 and 3, respectively, receive the nine bags.

The chart further indicates that after the first two cycles have been completed, one clamping unit 180 at a time will have accumulated 25 bags, and that all 25 bags will be discharged from that clamping unit onto wicket pins P, a shingling conveyor, or similar bag receiving mechanism.

During discharging of each group of bags at the discharge station DS, the accumulating drum 178 is bodily moved away from the bag making drum 50 and the peripheral speed of the drum is equal to its rolling speed across a stationary surface provided the bags are discharged on a stationary surface such as the wicket pins P, as opposed to a moving surface such as a shingling conveyor.

If a batch of shorter bags are to be run, the width adjusting mechanism 44 is adjusted accordingly. Since the leading edges of the shorter bags must be gripped by the clamping units 180, the location at which the clamping units 180 become tangent to the ribbon belts 174 must be adjusted so that these tangent points coincide with the location of the leading edges of the narrower bags. This adjustment is accomplished by adjusting the pinion gear 260 (FIG. 2) relative to the cog belt pulley 262 by means of the previously referred to screw and arcuate slot connectors 323.

Figure 14:
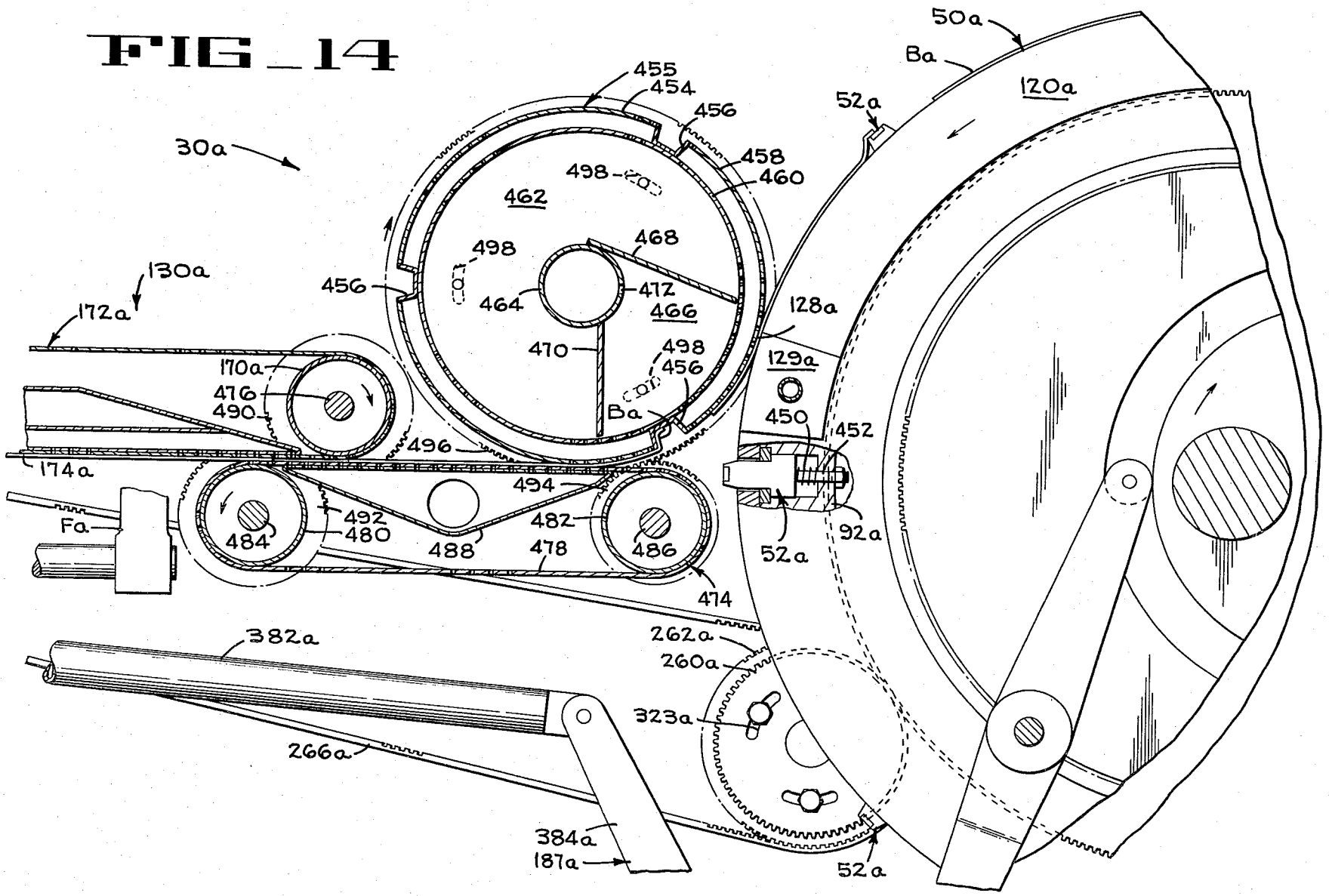
FIG. 14 is a diagrammatic elevation of a portion of a second embodiment of the invention, the portions of the second embodiment that differ from the first embodiment being illustrated in vertical section and only a fragment of the frame being shown.

The pertinent portions of the second embodiment of the bag making and accumulating machine 30*a* is diagrammatically illustrated in FIG. 14. Since many components of the second embodiment of the invention are identical to the first embodiment, only the differences will be described in detail. Components of the second embodiment that are similar to the first embodiment will be assigned the same numerals followed by the letter "a".

The bag making drum 50*a* of the second embodiment of the invention is identical to the drum 50 of the first embodiment except that the sealing pads 52*a* are not retractable and accordingly the mechanism for retracting the pads is omitted from the second embodiment. Each sealing pad 52*a* projects outwardly from the periphery of the drum and is resiliently maintained in that position by a plurality of springs 450 spaced longitudinally of the associated pad 52*a*. The springs 450 are wound about threaded studs 453 secured to the associated pad and projecting inwardly through the inner annular wall 92*a* of the drum 50*a*.

Since the sealing pads 52*a* are not retractable, the outer periphery 454 of the vacuum drum 455 must include equally spaced recesses 456 to accommodate the sealing pads 52*a*. In order to maintain control of and withdraw the bags Ba from the bag making drum 50*a* after the forward edges of the bags Ba have moved past the end 128*a* of the vacuum manifold 120*a* and past the high pressure air manifolds 129*a*, the outer generally cylindrical and periphery wall 458 as well as an inner cylindrical wall 460 are perforated. The inner cylindrical wall 460 and the outer cylindrical wall 458 are secured to end discs 462 (only one being shown) journaled on a stationary tubular shaft 464 secured to the frame Fa of the machine 30*a*. A vacuum chamber 466 is formed by a pair of plates 468 and 470 secured to the stationary tubular shaft 464 and terminating closely adjacent the inner cylindrical wall 460 and the end discs 462. A source of vacuum (not shown) is connected to the tubular shaft 464, which shaft is provided with perforations 472 communicating with the vacuum chamber 466. Thus, after the leading edges of the bags Ba move past the end 128*a* of the manifold 120*a*, the vacuum created in the chamber 466 plus the high pressure air from manifold 129*a* causes the bags to cling to the outer cylindrical wall 458 of the drum 455 thereby stripping the bags Ba from the bag making drum while retaining the predetermined space between the bags.

After the leading edge of the bags Ba have moved past the plate 470, the bags are transferred onto an intermediate bag transfer conveyor 474 which delivers the bags to the ribbon belt vacuum transport conveyor 172*a* which is the same as the conveyor 172 of the first embodiment except that the drum 170*a* is not a vacuum drum and is secured to a shaft 476 journaled in the frame of the machine.

The intermediate conveyor 474 comprises a plurality of spaced perforated ribbon belts 478 (only one being shown) trained around a pair of drums 480,482 secured to shafts 484,486 respectively which shafts are journaled in the machine frame. A vacuum manifold 488 is disposed below the upper run of the belts 478 and has perforations in its upper wall which register with the perforations in the ribbon belts 478 to transfer the bags from the drum 455 to the belts 478, and from the belts 478 to the ribbon belts 174*a* of the vacuum conveyor 172*a* of the bag stripping and clamping mechanism 130*a* without loss of spacing or control of the bags. The mechanism 130*a* (only partially shown) then collects or accumulates, and discharges the bags as disclosed in the first embodiment of the invention.

The drive system for the bag making drum 50*a* and the components upstream thereof is identical to that of the first embodiment. The drive for the bag stripping and clamping mechanism 130*a* including the vacuum conveyor 172*a* is likewise the same as in the first embodiment except that the cog belt 266*a* and the connecting rod 382*a* are longer.

The intermediate conveyor 474 is driven by gears 490,492 keyed to the rear shaft 476 of the conveyor 172*a* and to the forward shaft 484 of the intermediate conveyor 474, respectively. The drive for the vacuum drum 455 includes a drive gear 494 keyed on the shaft 486 and a large diameter gear 496, secured to the end disc 462 of the drum 455 by capscrews and arcuate slot connectors 498. The connectors 498 and connectors 323*a* which adjustably connects the gear 260*a* to the cog pulley 262*a* permits adjustment of the bag stripping and clamping mechanism 130*a* to handle bags of different widths.

A third embodiment of the bag making machine 30*b* (FIGS. 15–21) of the present invention is similar in many respects to the first embodiment. Accordingly, parts of the third embodiment which are equivalent to those of the first embodiment will be assigned the same numerals followed by the letter "b", and only those parts which differ from the first embodiment will be described in detail.

In general, the third embodiment of the bag making machine 30b differs from the first embodiment by providing a bag collecting or accumulating drum 178b which rotates about a fixed axis (rather than a cyclically movable axis) and is tangent to a first path partially defined by the periphery of the bag making drum 50b. The accumulating drum 178b collects bags Bb directly from the bag making drum and accumulates the bags into groups of predetermined numbers of bags (preferably 25) for deposit into a group collecting drum 510 journaled on a carriage 511. The drum 510 rotates about its axis, and the drum 510 and carriage 511 are both cyclically reciprocated along a second path. The collecting drum 510 is rotated and reciprocated at speeds which will collect one group of bags for each cycle and deposit the group of bags at a discharge station DSb (FIG. 15) by rolling the bags off the drum 510 without any relative motion in the direction of the second path. In other words, there will be no relative motion between the groups of bags and the bag group collecting mechanism in the direction of reciprocation of the carriage 511. The bag group collecting mechanism may be stationary wicket pins Pb of a wicketing conveyor 379b as illustrated or may be a shingling conveyor that is either intermittently or continuously driven or may be any other type of bag receiving mechanism.

The bag making drum 50b includes eight retractable sealing pads 52b and is the same as the drum 50 of the first embodiment (FIGS. 5 and 6) except that vacuum is drawn through a tubular drum shaft 112b rather than through manifolds at the ends of the drum. The end plates 106b are not provided with vacuum holes as in the first embodiment, but vacuum holes 514 are provided through the inner wall 92b of the drum into each air passage 95b to continually evacuate all passages 95b in the drum 50b. Also the perforated, curved stainless steel plates 98b have a plurality of grooves 516,517 formed therein to accommodate the several clamp fingers 304b of each bag clamping unit 180b and additional fingers 518 of another set of clamping units 519 of the accumulating drum, respectively. The grooves 516,517 must be sufficiently deep to permit the clamp fingers 304b,518 to open completely, and must be relatively long to permit the fingers to engage bags which vary considerably in width. The three clamping units 180b which are the same as in the first embodiment, are aided by the three additional clamping units 519 to provide complete control of the bags as they are being accumulated as will be described in detail later.

The drive system for the bag making drum 50b (FIG. 15), the sealing head 56b, the cam-gears 186b, and all other components upstream of the drum 50b is the same as that disclosed in the first embodiment, and continuously drives the drum 50b at the rate of up to about 500 bags per minute in the direction indicated by the arrows in FIG. 1. The cam-gears 186b are driven one revolution for each three and an eighth revolutions of the bag making drum 50b.

Figure 15:
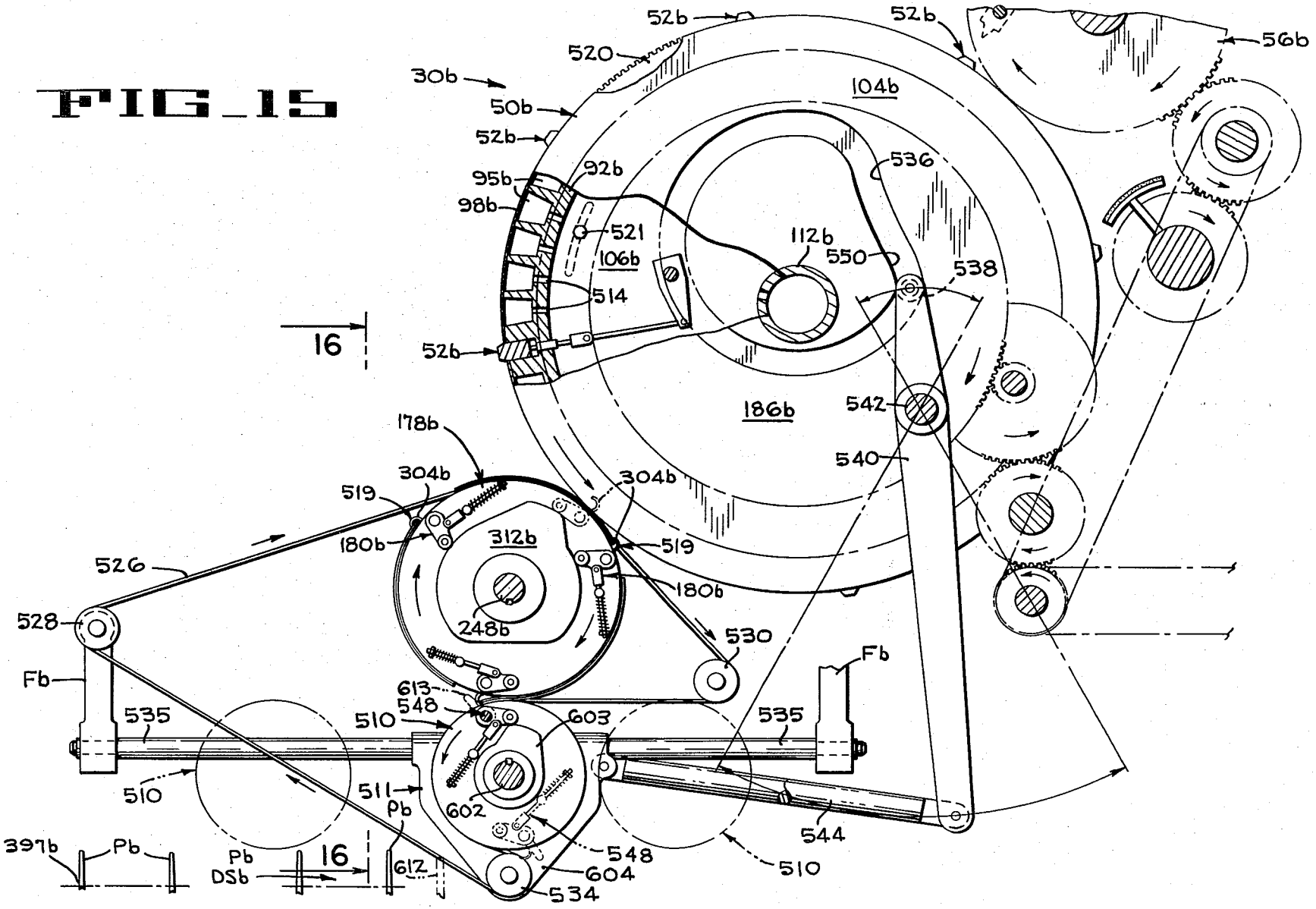
FIG. 15 is a diagrammatic side elevation of a third embodiment of a bag making and accumulating machine, certain parts being shown in sections and others in different operative positions.
Figure 16:
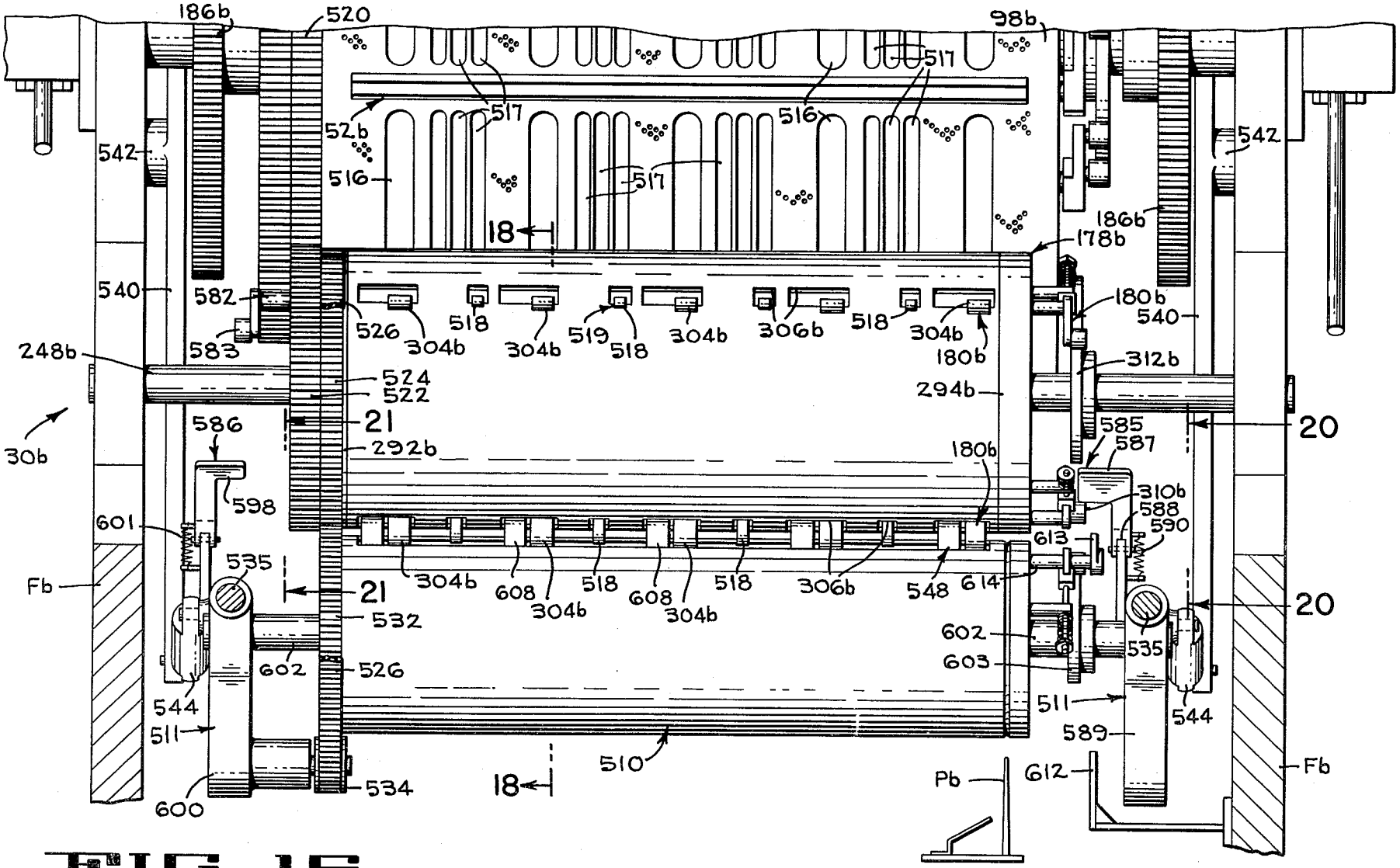
FIG. 16 is a section taken along lines 16—16 of FIG. 15.
Figure 17:
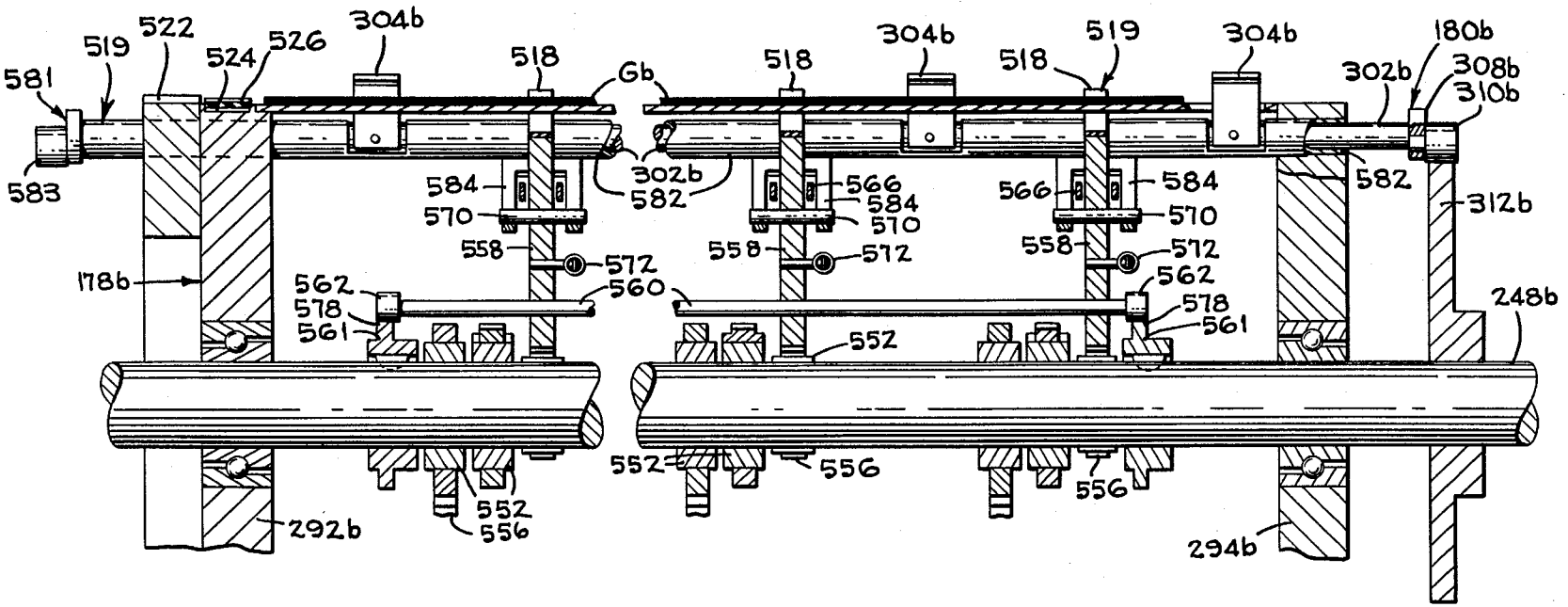
FIG. 17 is an enlarged section of a portion of the accumulating drum taken along lines 17—17 of FIG. 18.

As illustrated in FIGS. 15 and 16, the drive for the bag collecting or accumulating drum 178b is conveniently illustrated as including a drive gear 520 having a pitch diameter equal to the diameter of the drum 50b and connected to one of the end plates 106b by arcuate slot and cap screw connectors 521 to provide adjustment for bags of different widths. The gear 520 meshes with a gear 522 journaled on the stationary shaft 248b and secured to the end discs 292b of the accumulating drum 178b. The stationary shaft 248b is secured to the frame Fb of the machine 30b. The gear 522 and a concentric cog belt pulley 524 are of the same pitch diameter as the peripheral diameter of the accumulating drum 178b. Thus, the peripheral speed of the bag making drum 50b and the accumulating drum 178b are identical.

The collecting drum 510 is driven at the same peripheral speed as the drums 50b and 178b by a double cog belt 526 which is trained around the cog belt pulley 524, idler cog belt pulleys 528,530 journaled on the frame Fb, a cog belt pulley 532 (FIG. 16) secured to an end of and being the same diameter as the drum 510, and an idler pulley 534 journaled on the carriage 511.

The carriage 511 is slidably supported on a pair of slide bars 535 secured to the frame Fb and is reciprocated through one complete cycle for each three and one-eighth revolutions of the bag making drum 50b, which accordingly, makes 25 bags per cycle. In this regard, each cam gear 186b has a cam groove 536 (FIG. 15) therein within which a cam follower 538 on one end of lever 540 rides. The lever 540 is pivoted about a shaft 542 secured to the frame Fb. The other end of the lever 540 is pivotally attached to the carriage 511 by a link 544.

Figure 19:
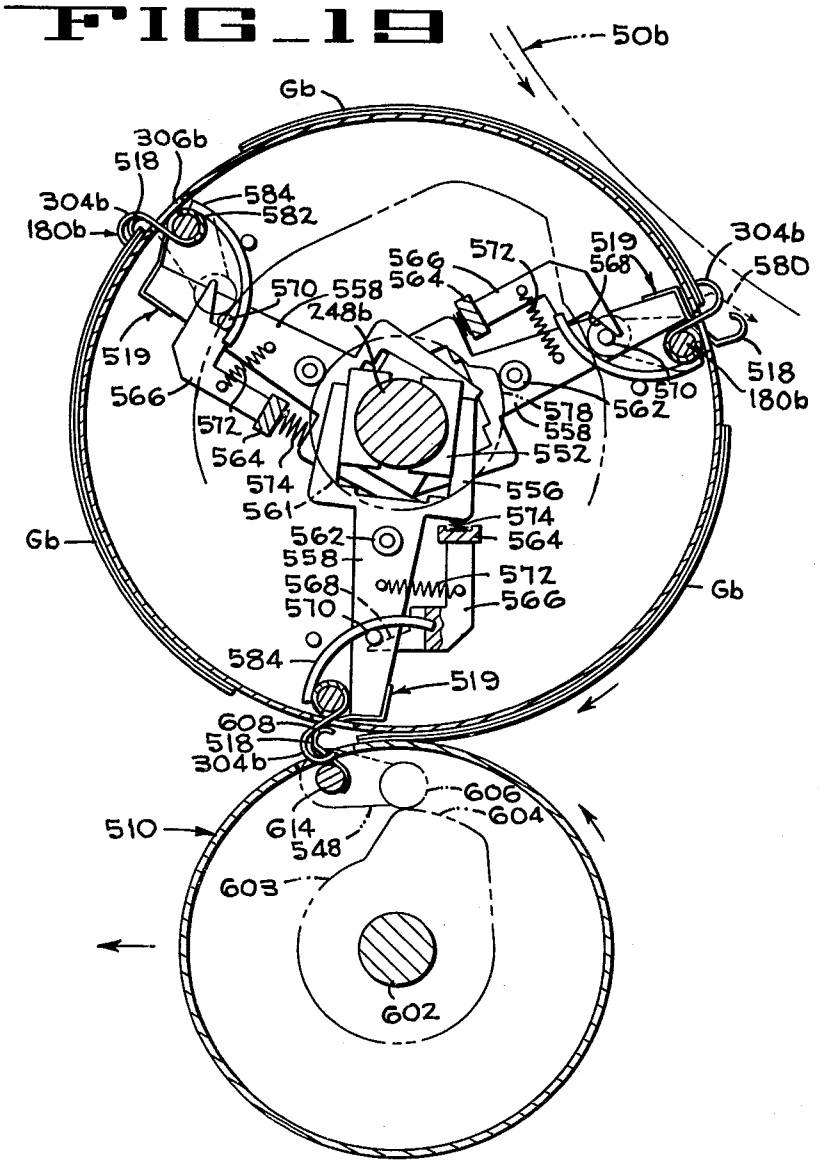
FIG. 19 is a transverse section similar to FIG. 18 but showing clamping units open and transferring a group of accumulated bags from the accumulating drum to the bag group collecting drum.
Figure 18:
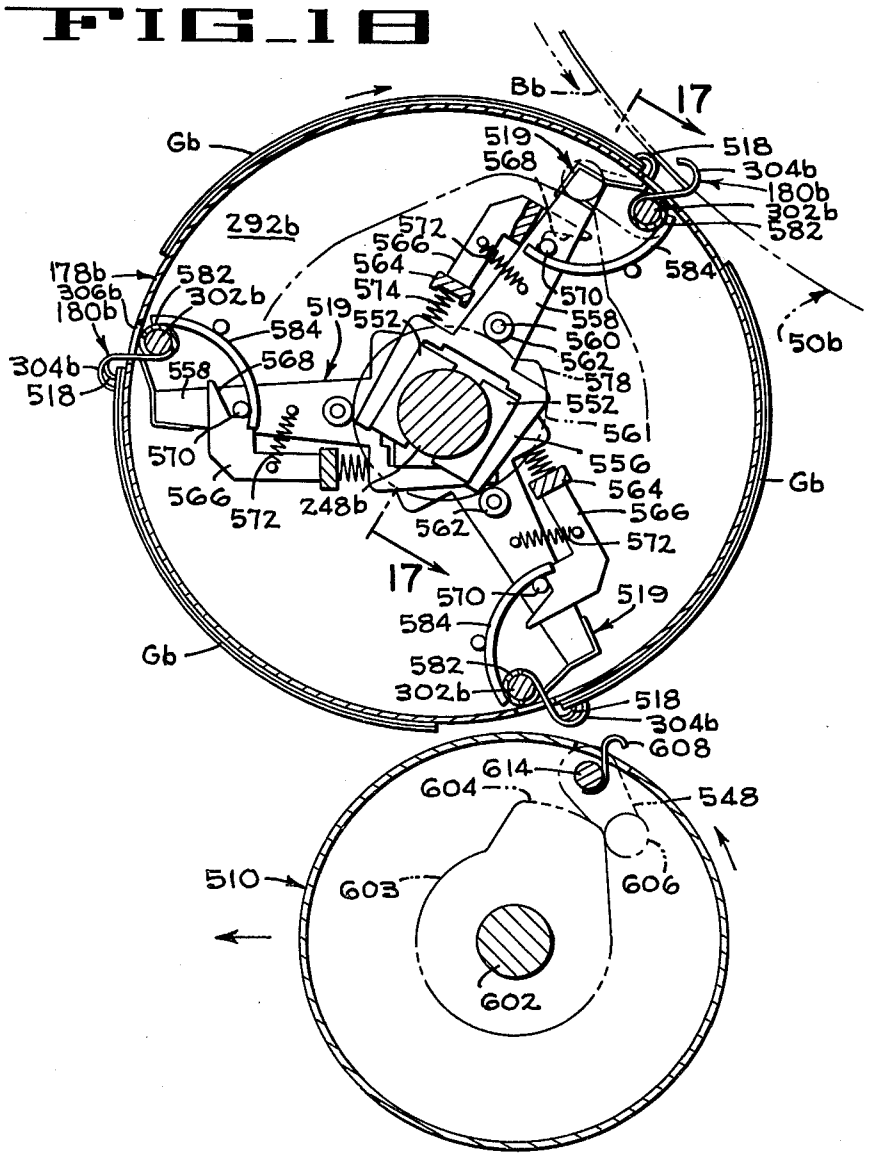
FIG. 18 is a transverse section taken along lines 18—18 of FIG. 16, of the accumulating drum and bag group collecting drum illustrating one of the double clamp units with one jaw open to receive a new bag from the bag making drum and the other jaw closed to clamp the already accumulated bags on the accumulating drum.

As illustrated in FIGS. 15,18 and 19, only one bag clamping unit 548 is provided on the periphery of the collecting drum 510. Thus, the timing is such that the cam groove 536 (which is illustrated diagrammatically) will cause the single bag clamping unit 548 to open and close on one group of bags to strip the bag group from the first double bag clamping unit 180b,519. During the next cycle, the bag making drum 50b with its eight sealing pads 52b will rotate three and one-eighths times making 25 bags; the bag collecting or accumulating drum 176b (with three double clamping units 180b,519) will rotate eight and one-third time collecting 25 bags from the drum 50b; and the bag clamping drum 510 (with the single bag clamping unit 548) will rotate 12 times and will collect a group of 25 bags from the second double clamping unit 180b,519. This operation is repeated for each cycle with the next cycle collecting 25 bags from the third double clamping units 180b,519.

It is apparent that since the peripheral speeds of the three drums 50b,178b and 510 (when the carriage is not moving) are the same. Since the drum 50b has eight sealing pads 52b that must register with three double clamping units 180b,519 on the accumulating drum 178b, and the clamping units 180b,519 must register with the single clamping unit 548 on the collecting drum 510, it is apparent that the diameters of the three drums are critical for proper registration. It will be understood, however, that the collecting drum 510 may be made of larger diameter for slower revolutions during bag group discharge if desired provided the diameter ratio is such that the single clamping unit 548 will sequentially register with one of the three double clamping units 180b,519 per cycle.

It will be understood that the peripheral speed of the drum 510 will be in the same direction and at the same speed as the peripheral speed of the drum 178b, when the two drums are tangent as indicated in solid lines in FIG. 15 provided the drums 510 and carriage 511 are held from linear movement at this time. When the carriage and drum 510 are being reciprocated toward the left (FIG. 15) its rate of rotation will be relatively slow since it is moving in the same direction as the cog belt 526. When the carriage and drum 510 are moving toward the right (FIG. 15) its rate of rotation will increase. However, since both drums **178*b* and 510 are driven by the cog belt 526, there will be no speed differential between the two drums at their point in tangency. Thus, movement of the empty drum 510 from the discharge station DSb toward the right under the drum 178*b* will have no adverse affect on the bags being collected on the drum 178*b***.

The cam groove 536 (and the identical grove not shown on the other side of the machine) are diagrammatically illustrated in FIG. 15. The groove as illustrated includes a relatively slow speed portion extending from the cam follower 538 to a point 550 at which time the linear movement of the collecting drum 510 and carriage 511 to the left (FIG. 15) is relatively slow to permit a more reliable transfer of the accumulated bags from the double clamping units **180*b*,519 into the clamping unit 548. It will be understood that the slow speed portion moves the carriage 511 to the left at a speed faster than the speed of the horizontal components of the clamping units 180*b* and 519 to assure closing of the clamping units 548 on the group of bags before the clamping units 180*b*, 519 close. Shortly after the trailing edge of the bag group clears the tangent point, the cam contour moves the carriage 511 to the left at a linear speed which will roll the bag group out at the discharge station DSb. If the bag group is discharged on stationary wicket pins Pb (or other stationary collecting means), then the linear speed of the carriage 511 will be one-half that of the peripheral speed of the drum 510. If the groups of bags are discharged upon a moving surface such as a slowly moving shingling conveyor, then the cam will be contoured so that there will be no speed differential in the direction of movement of the carriage 511** between the group of bags being discharged in the mechanism which receives the discharged group of bags.

The gripping units **180*b* within the bag collecting or accumulating drum 178*b*, and the portion of the fixed cam 312*b* are substantially the same as in the first embodiment except that the parts are reversed because the drum 178 (FIG. 10) of the first embodiment is rotated counterclockwise whereas the drum 178*b* (FIG. 15**) of the second embodiment is rotated clockwise.

The previously mentioned second set of bag clamping units 519 (FIGS. 17, 18 and 19) are provided to maintain clamping engagement of the accumulated bags when the associated clamping units **180*b* are open to receive a new bag from the bag making drum 50*b*. After the open clamping unit 180*b* has clamped the new bag to the accumulated bags thereunder, the clamping fingers 518 of the associated unit 519** are thereafter momentarily moved out from under the newly added bag and then return into clamping engagement against the new bag to clamp the new bag on the previously accumulated bags therebelow.

The three bag clamping units 519 are staggered transversely of the drum **178*b* and thus requires the three sets of grooves 517, in the drum 50*b* (FIG. 16) to permit the fingers 518 to open. Each bag clamping unit 519 comprises several pairs of split blocks 522 (FIG. 18) journaled on the stationary shaft 248*b* and slidably received in ways formed in yokes 556 having a plurality of radially extending arms 558 integral therewith. The arms 558 are interconnected by a transverse rod 560 which extends to a point above stationary cams 561 (FIG. 17) secured to the stationary shaft 248*b*. Cam followers 562 are journaled on the end portions of the rod 560 and ride on the cams 561**.

The finger 518 on the upper end of each radial arm 558 projects through an opening or slot **306*b* (FIG. 16) in the drum 178*b* and has one of the clamp fingers 518** secured to the upper end thereof in position to engage the bags being accumulated, and to clamp them against the periphery of the accumulating drum.

A transversely extending bar 564 (FIG. 18) is secured to the end plates **292*b* and 294*b* and carries a plurality of spaced arm guides 566 having forked outer ends within which the several arms 558 are slidably received. Camming surfaces 568 are formed on the forked ends of the arm guides 566 which engage cam followers 570 carried by the several arms 558. Springs 572 maintain the cam followers 570 in engagement with the cam surfaces 568, and other springs 574 are disposed between the bar 564 and the portion of the arms 558** to normally urge the clamp fingers into clamping engagement with the bags being accumulated.

After one of the gripping units **180*b* has first opened to release the accumulated bags and has thereafter closed to clamp the new bag received from the bag making drum 50*b* against the previously accumulated bags, the associated clamping unit 519 is opened. During opening of the clamping unit 519, the cam followers 562 engage lobes 578 on cams 561 secured to the stationary shaft 248*b*. As the arms 558 move radially outward, the gripping fingers 518 first release clamping pressure on the bags and then move generally circumferentially along path 580 (FIG. 19) away from the leading edges of the bags until they are moved out from under the newly added bag. Thereafter, the cam followers 562 ride off the lobes 578** and return by reversing their opening motion to clamp the new bag on the previously accumulated bags.

It will be noted that the lobes 578 of the cams 561 open the three clamping units 519 every time a new bag has been received from the bag making drum **50*b* and is clamped to the accumulated bags by the associated clamping unit 180*b***.

Since the accumulating drum **178*b* rotates $8\frac{1}{3}$ revolutions per cycle, and since only one group of bags is discharged per cycle, a separate accumulated drum clamp releasing mechanism 581 (FIGS. 17, 20 and 21) is provided for opening one of the double clamping units 180*b*,519** per cycle.

The clamp releasing mechanism 581 includes a tubular shaft 582 (FIGS. 17 and 21) that is journaled on the shaft **302*b* of the associated clamping unit 180*b*. The tubular shaft 582 has a lever and cam follower 583 on its right end. Portions of the tubular shaft 582 are cut away to permit the fingers 304*b* to be secured to the shaft 302*b* and also to permit relative movement between the shafts 302*b* and 582. A plurality of lifting forks 584 are secured to the tubular shaft 582 and are disposed in position to engage the cam followers 570 and thereby open the associated clamping unit 519 in response to the lever and cam follower 583** being pivoted in a clamp opening direction.

The clamp releasing mechanism 581 also includes a pair of pivoted cam mechanisms 585 and 586 (FIG. 16) supported by the reciprocating carriage 511 for engaging the cam followers **310*b* and 583, respectively, to open one of the clamping units 180*b* and 519**, respectively, per cycle.

As mentioned previously, a full group of bags (25 bags) per cycle is released from both clamps **180*b* and 519 that cooperate to define a double clamping unit and extend through transversely aligned slots 306b in the accumulating drum 178b. The released group of bags are simultaneously gripped by the single clamping unit 548 of the collecting drum 510**.

The pair of pivoted cam mechanisms 585 and 586 (FIG. 16) are supported on the carriage 511 and are provided for opening the double clamping units 180,519 to release groups of bags into the collecting drum 510. The left mechanism 585 (FIGS. 16 and 20) comprise an arcuate cam plate 587 (FIG. 20) (shown in three operative positions) pivoted about a pivot pin 588 to the left end plate 589 of the carriage 511. A spring 590 is connected between an ear 592 rigid with the cam 587, and a pin 593 secured to the left end plate 589 of the carriage. The spring 590 holds the ear 592 against an abutment surface 594 on the left end plate 589 so that a camming surface 596 of the arcuate cam 584 will be in position to engage and actuate the cam followers 310b of each of the clamping units 180b to open the fingers 304b when the carriage is moving to the left (FIGS. 15 and 20). The rate of movement of the carriage 511 to the left is faster than the movement of the cam follower 310b, and accordingly progressively opens the clamping unit 180b as indicated in FIG. 20. The right cam mechanism 586 (FIG. 21) is substantially the same as the left cam mechanism 585 and is provided to open the clamping unit 519. The cam mechanism 586 include an arcuate cam plate 598 pivoted to the right end plate 600 of the carriage 511 and resiliently held in place by a spring 601. When the arcuate cam 598 contacts the cam follower 583, the tubular shaft 582 is pivoted to open the clamping unit 519.

When the carriage 511 is moving toward the right (FIG. 15) past the accumulating drum 178b, the two arcuate cam plates 587 and 598 of the mechanisms 585 and 586 will be pivoted downwardly in the event they are contacted by the cam followers.

The collecting drum 510 is journaled on a stationary shaft 602 (FIGS. 16,18 and 19) having a stationary cam 603 secured thereto. A lobe 604 of the cam 603 contacts a cam follower 606 of the single clamping unit 548 which is identical to the clamping units 180b but is oriented for rotation in the opposite direction, and also has its bag clamping fingers 608 spaced transversely of the bag clamping fingers of the clamping units 180b and 519.

After the bag group being discharged has been transferred onto the stationary wicket pins Pb (FIG. 15), a stationary cam 612 secured to the frame Fb contacts a finger 613 rigid with the shaft 614 of the clamping unit 548 to open the clamping unit 548 and release the bag group from the collecting drum 510. As in the other embodiments, the bag groups are rolled out onto a collecting mechanism such as wicket pins Pb with the relative velocity between the bag group and the bag group collecting mechanism being zero.

The above described cycle of operation is repeated for each of the three double clamping units 180b, 519 on the accumulating drum 178b.

Figure 22:
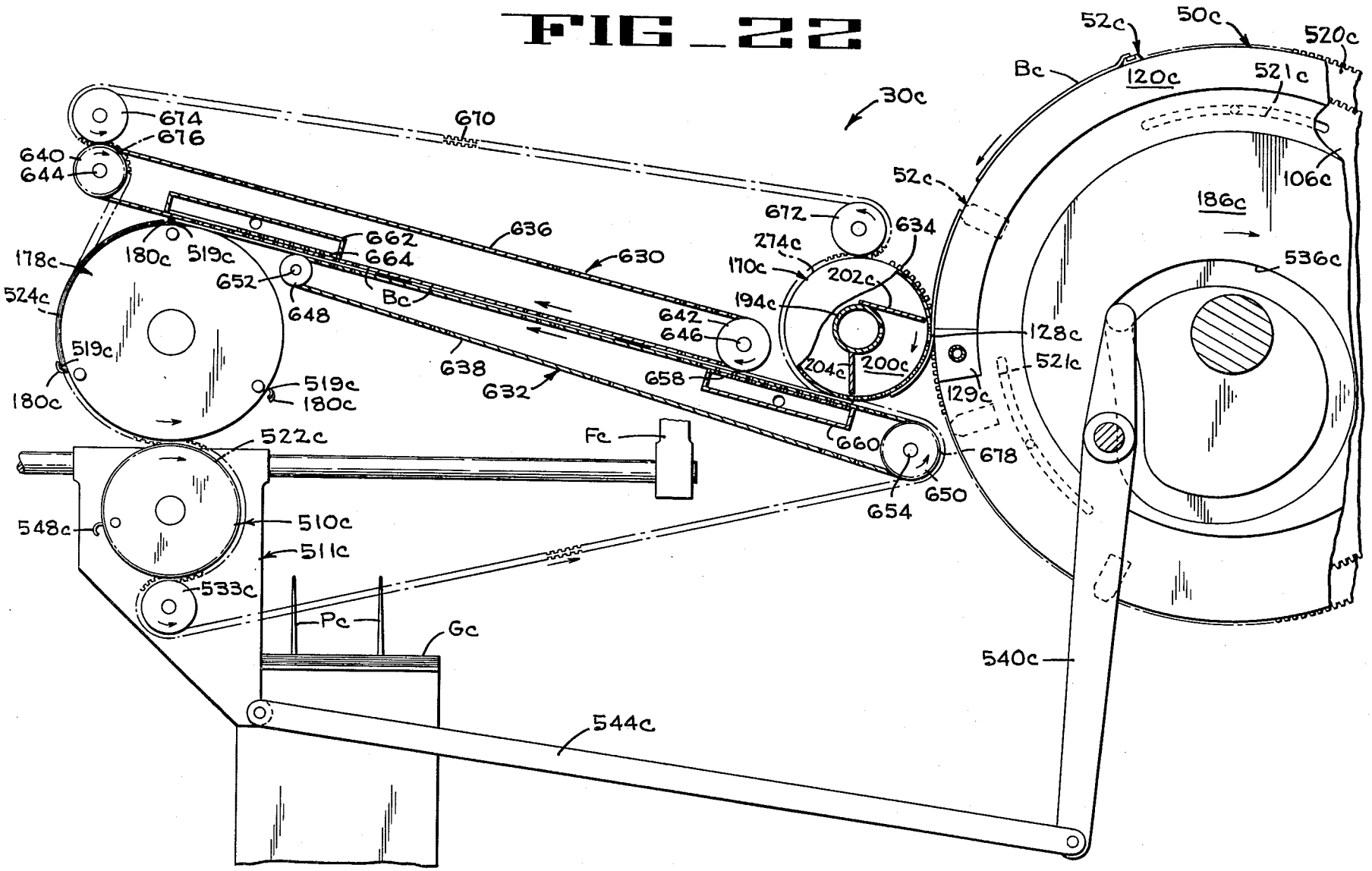
FIG. 22 is a diagrammatic side elevation of a fourth embodiment of the invention, certain parts being shown in section and other parts being cut away.
Figure 23:
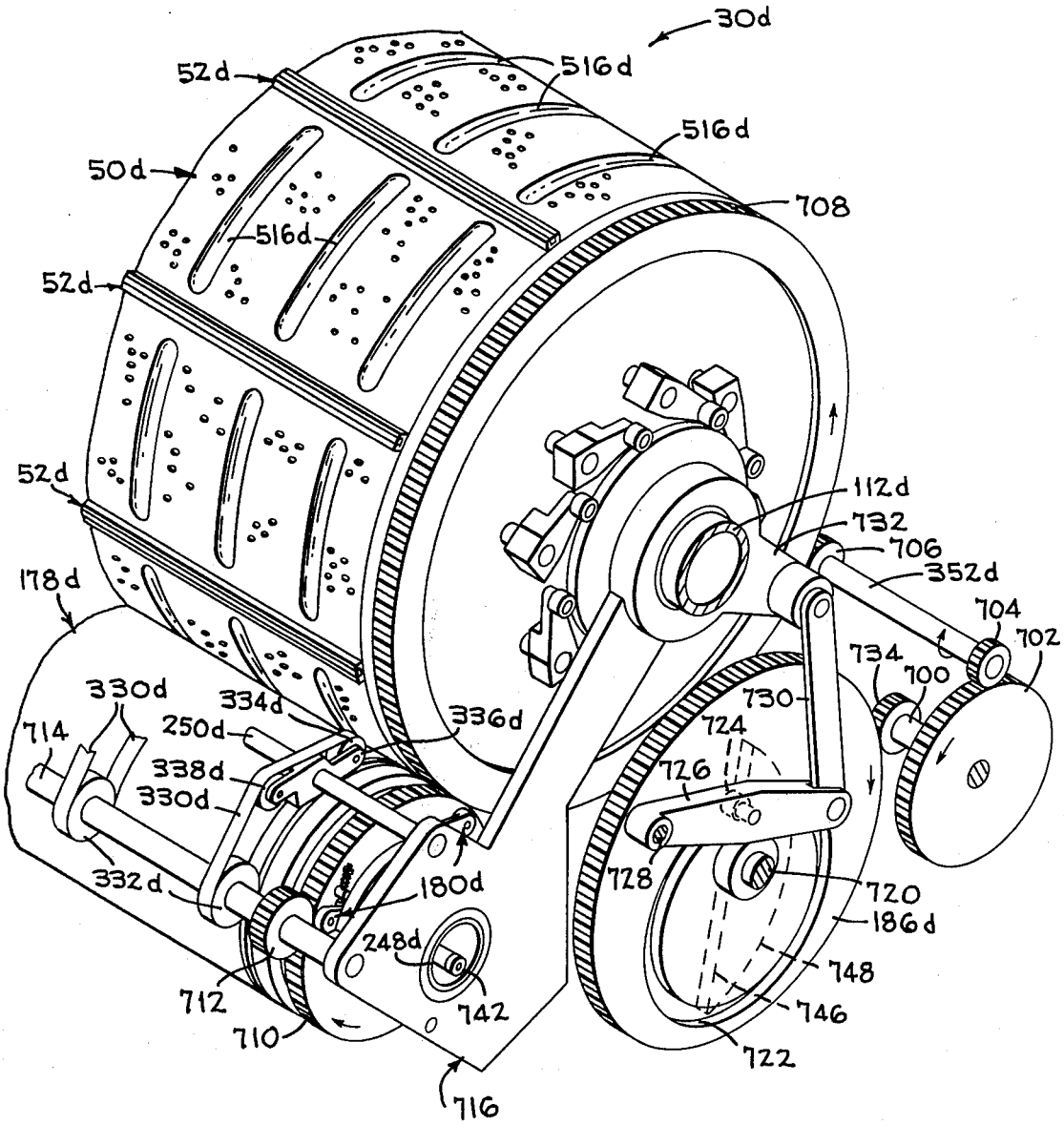
FIG. 23 is a diagrammatic perspective of a portion of a fifth embodiment of the invention, certain parts common to the other embodiments being omitted.
Figure 24:
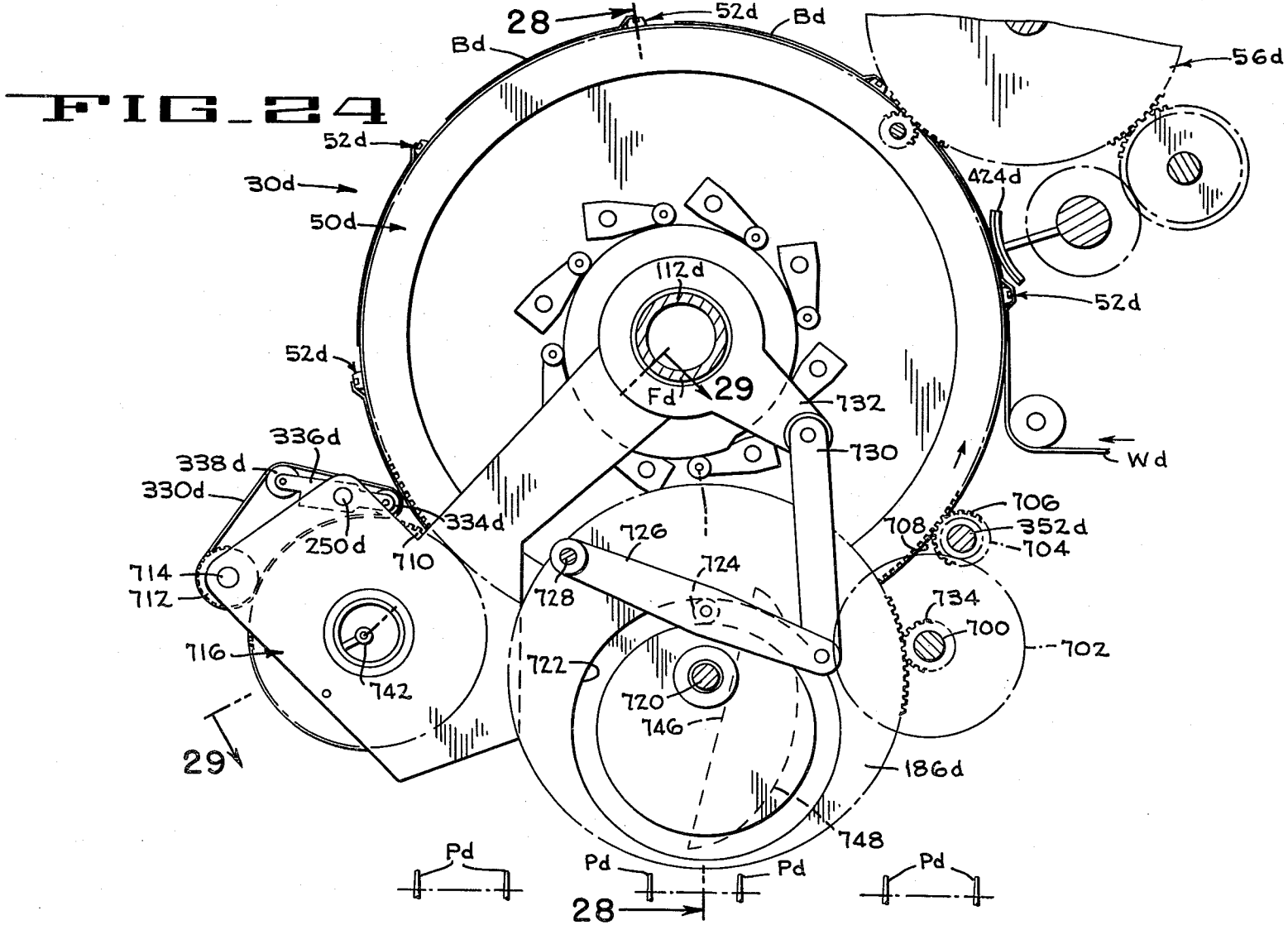
FIG. 24 is a side elevation of the fifth embodiment.

A fourth embodiment of the bag making and accumulating machine 30c is diagrammatically illustrated in FIG. 22 and features a pair of elongated confronting bag transport conveyors 630 and 632. The conveyors 630, 632 provide additional travel for the bags Bc before accumulation thus providing more time for the heat sealed edges of the bags to cool below a temperature wherein the melted thermosealing material is sticky.

Except for the transport conveyors 630 and 632, and the parts associated therewith, the fourth embodiment of the invention is similar to portions of the first embodiment (FIGS. 1–6 and 9) and the third embodiment (FIGS. 15–21). Accordingly, parts of the apparatus 30c that are similar to parts of the first and third embodiments will be assigned the same numerals followed by the letter "c".

The bag making drum 50c (which includes eight retractable sealing pads 52c) and the components upstream of the drum including the drive system for the bag making drum 52c and the cam-gears 186c (only one being shown) are the same as in the first embodiment. The vacuum drum 170c is also the same as in the first embodiment but is driven by a large gear 520c that is connected to one end disc 106c of the drum 50c by arcuate slot and capscrew connectors 521c thereby providing bag width adjustment. The pitch diameter of the gear 518c is equal to the diameter of the drum 50c. The gear 518c meshes with a gear 634 which is journaled about the stationary shaft 194c of the vacuum drum 170c, which sprocket has the same pitch diameter as the diameter of the vacuum drum 170c.

The conveyors 630 and 632 each include a plurality of transversely spaced, perforated ribbon belts 636 and 638, respectively, for gripping the bags between and advancing them at intervals without losing the desired spacing. The conveyor belts 636 are trained around a plurality of spaced rolls 640 and 642 keyed to shafts 644 and 646, respectively. The shafts 644 and 646 are journaled in the frame Fc of the bag making and accumulating machine 30c. Similarly, the belts 638 are trained around pulleys 648 and 650 keyed to shafts 652 and 654, respectively, journaled in the frame Fc.

The vacuum drum 170c includes the vacuum chamber 200c defined by the stationary plates 202c and 204c. As the bags Bc move past the trailing end 128c of the manifolds 120c, they are stripped from the vacuum drum 170c and are caused to cling to the perforated belts 638 of the conveyor 632 by vacuum drawn through the belts 638 and through perforations in the upper wall 658 of a vacuum chamber 660. The bags Bc then move between the belts 636 and 638 for transport below a second vacuum chamber 662 having perforations in its lower wall 664 that hold the bags to the belt 636 until they are stripped therefrom by clamping engagement of the clamping units 180c of an accumulating drum 178c.

The accumulating drum 178c; the bag group collecting drum drive 510c; the carriage 511c; the cam grooves 536c in the cam-gears 186c (only one being shown) and the cam operated lever 540c and link 544c are all substantially the same as disclosed in the third embodiment.

The primary differences between the third and fourth embodiments are that the accumulating drum 178c and bag group collecting drum 510c are driven in the opposite direction relative to the drums 178b and 510b of the third embodiment. Thus, the double clamping units 180c, 519c of the accumulating drum 178c; and the single clamping unit 548c of the collecting drum 510c along with their operating mechanisms (not shown) and the cam grooves 536c are reversed as compared to the equivalent structure described in the third embodiment and thus will not be described in detail. Also, the groups of bags are discharged from the collecting drum 510c when the drum is moving toward the right (FIG. 22) not toward the left as in the third embodiment.

A double sided cog belt 670 is provided in order to drive the conveyors 630 and 632, and the drum 178c and 510c in the proper directions as indicated by the arrows in FIG. 22. The cog belt 670 is trained around a cog belt pulley 274c secured to the vacuum drum 170c; around idler pulleys 672 and 674 journaled on the frame Fc; around a cog belt pulley 676 secured to the drive shaft 644 of the conveyor 630; around a cog belt pulley 524c secured to the accumulating drum 178c; around cog belt pulley 532c secured to the collecting drum 510c; around an idler pulley 532c journaled on the carriage 511c; and around a cog belt pulley 678 secured to the drive shaft 654 of the conveyor 632 for return around the cog belt pulley 274c. The cog belt pulleys 274c, 676, 524c, 532c and 650 have pitch diameters which equal the diameters of the vacuum drum 274c, the drive pulleys 640 of the conveyor 630, the accumulating drum 178c, the collecting drum 510c, and the drive pulley 650 of the conveyor 632, respectively.

The fifth embodiment of the bag making and accumulating machine 30d (FIGS. 23–28) includes a continuously driven bag making drum 50d having eight retractably sealing pads 52d thereon, and an accumulating or bag collecting drum 178d that swings about the axis of the drum 50d in the nature of a pendulum and includes three equally spaced clamping units 180d.

Since many components of the machine 30d are the same or similar to components of earlier described embodiments, only the differences between the fifth embodiment and the earlier described embodiments will be described in detail. Parts of the fifth embodiment that are similar to those of the other embodiments will be assigned the same numerals followed by the letter "d".

The bag making drum 50d is substantially the same as that of the third embodiment in that the entire drum is vacuumized through the stationary tubular shaft 112d, and the perforated periphery of the drum 50d is provided with grooves 516d (FIG. 23) to permit opening of the clamping units 180d carried by the accumulating drum.

The drive to the components (including the bag width adjustment mechanism) of the bag machine 30d upstream of the bag making drum 50d is the same as described in the first embodiment except that the motor is not connected directly to the hand wheel shaft 352d (FIGS. 23 and 24) but instead is connected to a shaft 700 journaled on the frame Fd (only fragments being shown). The shaft 700 has a gear 702 keyed thereon which meshes with a gear 704 on the handwheel shaft 352d to drive that shaft in a direction that is reverse relative to the handwheel shafts of the other embodiments. The drum 50d is driven in the direction indicated by the arrow by a pinion 706 on the handwheel shaft 352d which meshes with a bull gear 708 that is secured to the bag making drum 50d and has a pitch diameter equal to the diameter of the bag making drum 50d. The bull gear 708 is preferably connected to the drum 50d by an arcuate slot and capscrew connected (not shown) for bag width adjustment as in the other embodiments of the invention.

The collecting drum 178d is driven directly from the bull gear 708 which meshes with a gear 710 secured to and of the same pitch diameter as the collecting drum 178d. The gear 710 meshes with a pinion gear 712 keyed to a shaft 714 journaled on a pendulum frame 716 (only one arm being shown) which pivotally supports the accumulating drum 178d on the stationary shaft 112d. A plurality of spaced pulleys 332d are keyed to and are of the same diameter as the gear 712 for driving a plurality of ribbon hold-down belts 330d at the same peripheral speed as the accumulating drum 178d. The belts 330d are trained around pulleys 334d,338d journaled on brackets 336d secured to a shaft 250d on the pendulum frame 716 as in the first embodiment of the invention.

A plurality of spaced arcuate plates 717 (FIG. 25) are secured to the pendulum frame 716 by brackets 718 and have clamping finger accommodating spaces therebetween which are aligned with the grooves 516d (FIG. 23) in the drum 50d to receive the fingers of the clamping units 180d. The use of the hold-down belts 330d and the arcuate plates 717 eliminate the need for the double clamping fingers in the third and fourth embodiments.

A pair of cam-gears 186d (only one being shown) differ from the cam-gears of the other embodiments in that they are not journaled on the stationary bag making drum shaft 112d but instead are journaled on the frame Fd by a stub shaft 720. (FIGS. 24 and 28) Each cam-gear 186d includes a cam track 722 which receives a cam follower 724 journaled on a lever 726. Each lever 726 is pivoted at one end to the frame Fd by a pin 728 (FIGS. 23 and 24) and is pivotally connected at the other end to a link 730. The other end of the link 730 is pivoted to a lever arm 732 of the pendulum frame 716.

The single illustrated cam-gear 186d is driven by a pinion 734 secured to the shaft 700. The other cam-gear (not shown) is driven through the handwheel shaft 352d by a gear train identical to the gear train 702,700 and 734 (not shown).

As in the other embodiments, the gear and sprocket ratios are such as to drive the cam-gears 186d one revolution per cycle during which time a group of twenty-five bags are discharged onto wicket pins Pd, or upon another type of bag group receiving mechanism. During each cycle the bag making drum 50d rotates $3\frac{1}{8}$ revolutions; the accumulating drum rotates $8\frac{1}{3}$ revolutions, and is arcuately swung through one complete oscillation, the sealing head 56d (FIG. 24) rotates $12\frac{1}{2}$ revolutions, and the snubber 424d rotates twenty-five revolutions.

Figure 25:
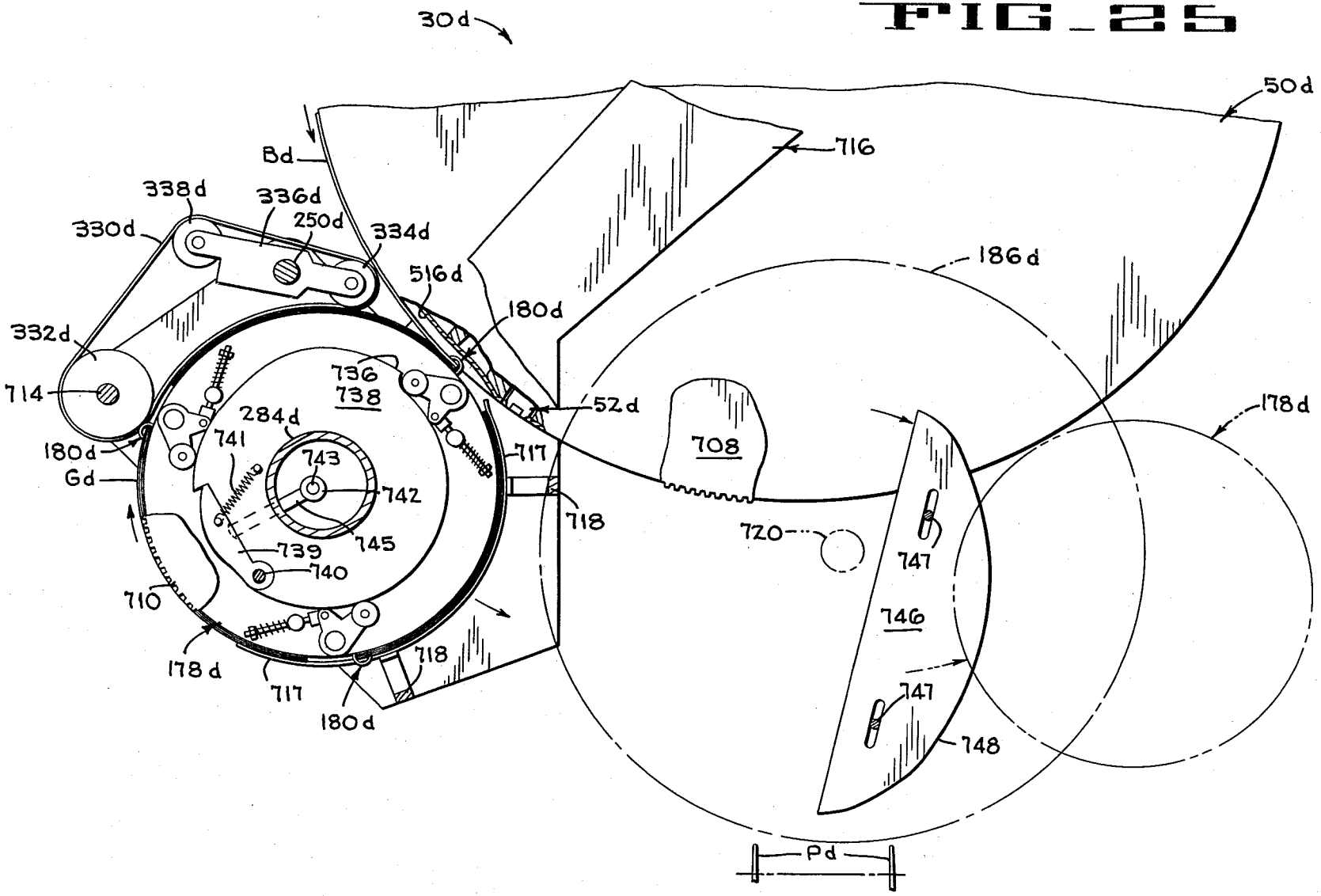
FIG. 25 is an enlarged operational view in side elevation and with the accumulating drum being shown in section to illustrate the bag clamping units and cams for operating the same.
Figure 27:
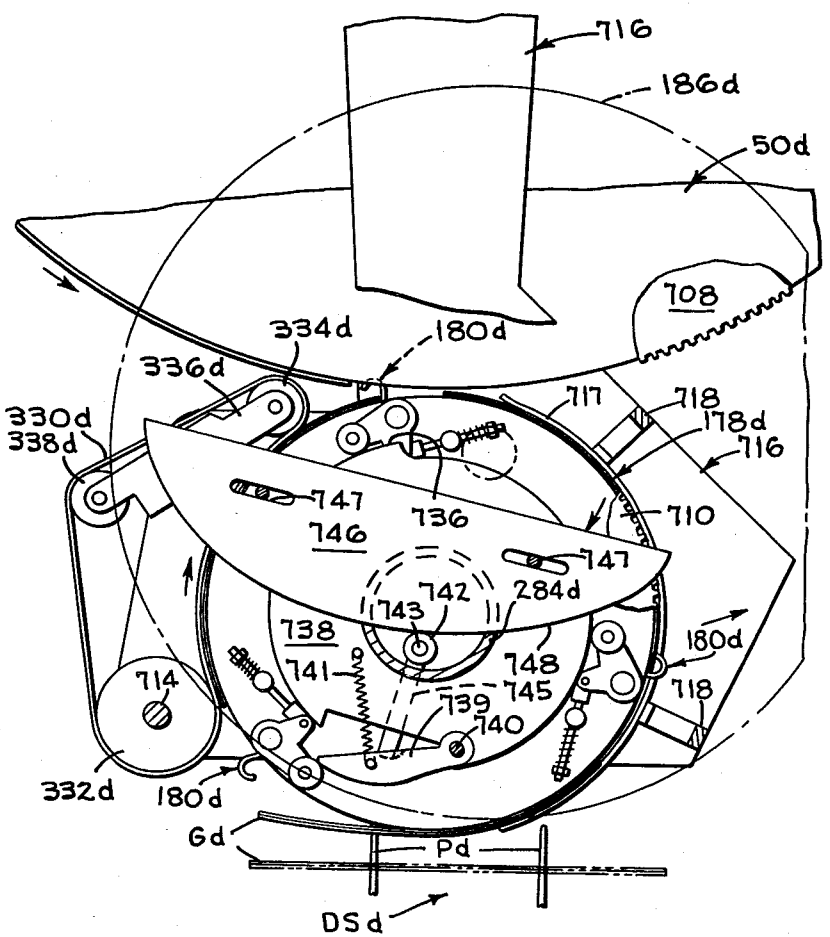
FIGS. 26 and 27 are progressive operational views illustrating the structure for opening one of the clamping units to discharge a full group of bags on wicket pins.

As the cam-gears 186d rotate, it will be understood that the bull gear 708 and cam tracks 722 (which are diagrammatically illustrated in FIGS. 23 and 24) will cause the accumulating drum 178d to rotate and also oscillate bodily through about 75° between the position illustrated in FIG. 25 to the bag group discharged position illustrated in FIG. 27. It will also be understood that the cam track 722 is contoured to cause the bag groups Gd to roll out at the discharge station DSd without any appreciable relative movement between the bag group Gd and the wicket pins Pd.

During each cycle, the clamping units 180d will be opened each time they become tangent to the bag making drum 50d by the lobe 736 (FIGS. 25–27) of a non-rotatable cam 738 secured to the non-rotatable shaft 284d of the accumulating drum 178d. It will be recognized that these tangent points occur at several angular positions around the lower portion of the bag making drum 50 and that eight bags will be accumulated in two of the clamping units 180d and nine bags will be accumulated in the third unit 180d per cycle. The nine bags will be sequentially accumulated by different ones of the clamping units 180d during successive cycles.

Figure 29:
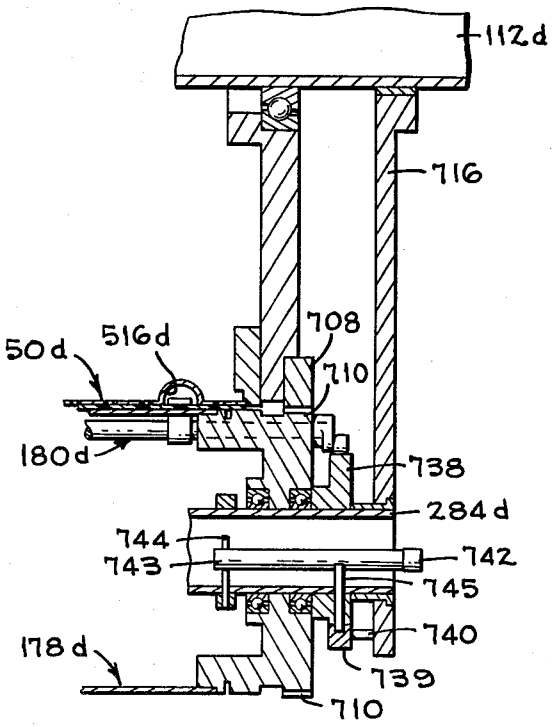
FIG. 29 is a section taken along lines 29—29 of FIG. 24.
Figure 28:
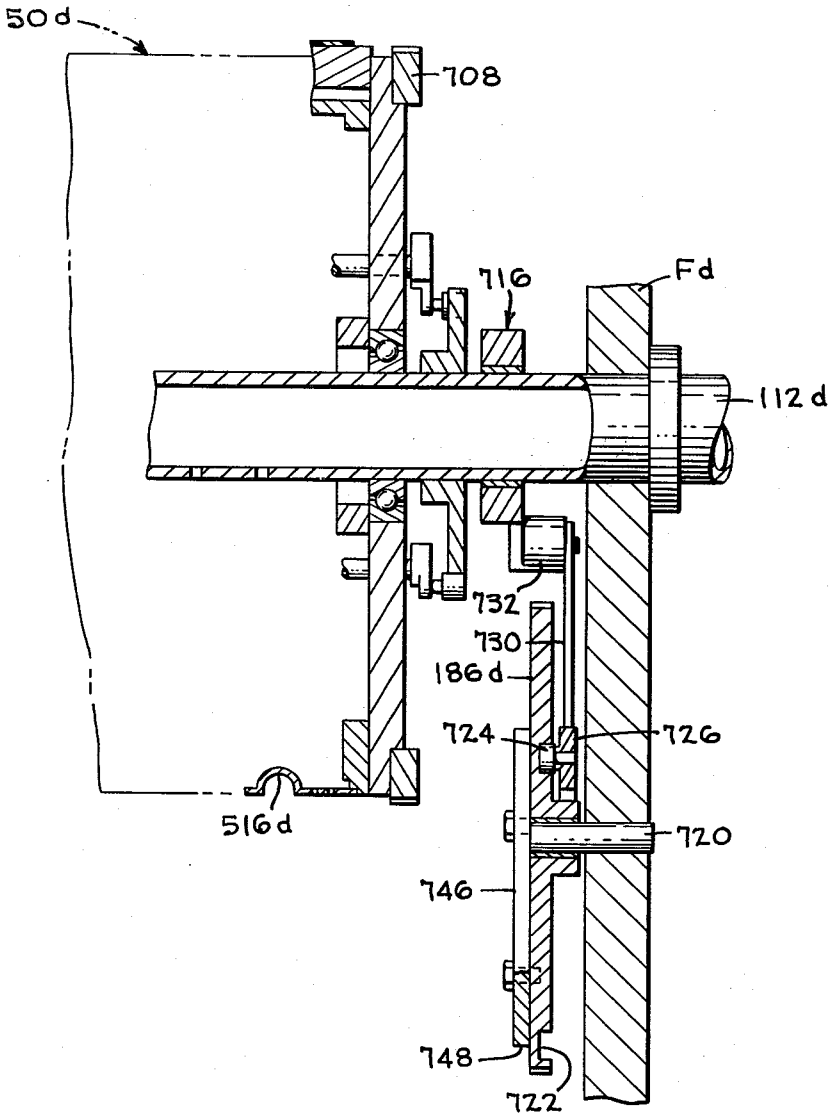
FIG. 28 is a section taken along lines 28—28 of FIG. 24 illustrating certain of the drive parts and cam components.

In order to discharge one group Gd of bags Bd per cycle on the wicket pins Pd, a cam gate 739 (FIGS. 25,26 and 27) is pivoted to the non-rotatable cam 738 by a pin 740 and is normally urged into its inoperative position by a spring 741 connected between the cam gate 739 and cam 738. A cam follower 742 is journaled on the end of a rod 743 (FIG. 29). The rod 743 is mounted for axial movement in the tubular shaft **284*d* by a pair of guide pins 744 and 745. The pin 745 is slidably received in a bore in the cam 738 and engages a groove in the gate 739 to move the gate outward to open one of the clamping units 180*d* each time it is desired to discharge a group Gd of bags, i.e., once each 8⅓ revolutions of the accumulating drum 178**d.

Figure 26:
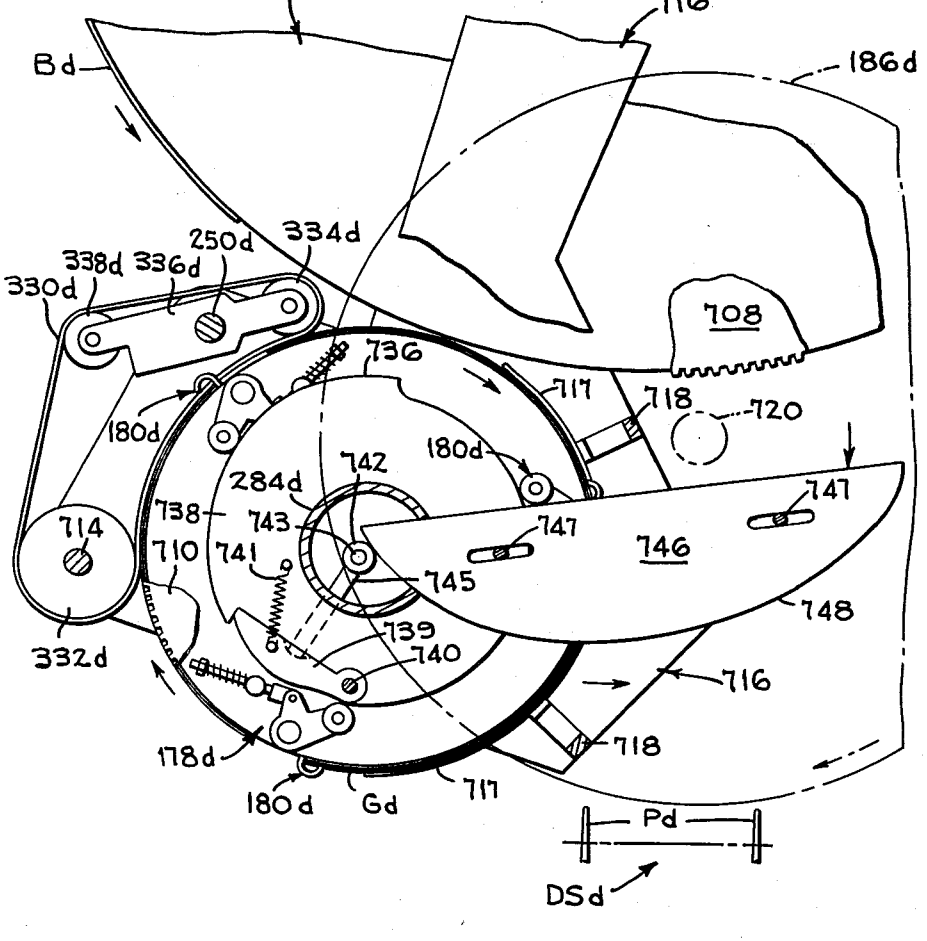

In order to actuate the gate 739 at the discharge station DSd, a half-moon cam 746 is connected to one of the cam-gears **186*d* by capscrew and slot connectors 747 in position to engage the cam follower 742. The contour of the camming surface 748 of the cam 752 is designed to start opening the gate 739 when the parts are positioned as indicated in FIG. 26 and to hole the gate 739 open as indicated in FIG. 27**.

Opening of the gate 739 is effective to open only one clamping unit **180*d* per cycle (FIG. 27) thus releasing one full group of twenty-five bags per cycle. It will be appreciated that the camming surface 748 is designed to compensate for simultaneous rotation of the accumulating drum 178*d* in a clockwise direction, rotation of the cam-gear 186*d* and the half-moon cam 746 in a clockwise direction, and bodily movement of the accumulating drum 178*d* in a counterclockwise direction all as indicated in FIGS. 25–27**.

As mentioned in regard to the first embodiment of the bag making and accumulating machine 30 (FIG. 1), a wicket hole punching device 401 may be positioned directly below the vacuum drum 170 to punch the holes H in the bags for receiving the wicket pins P of the wicket conveyor 397.

Figure 30:
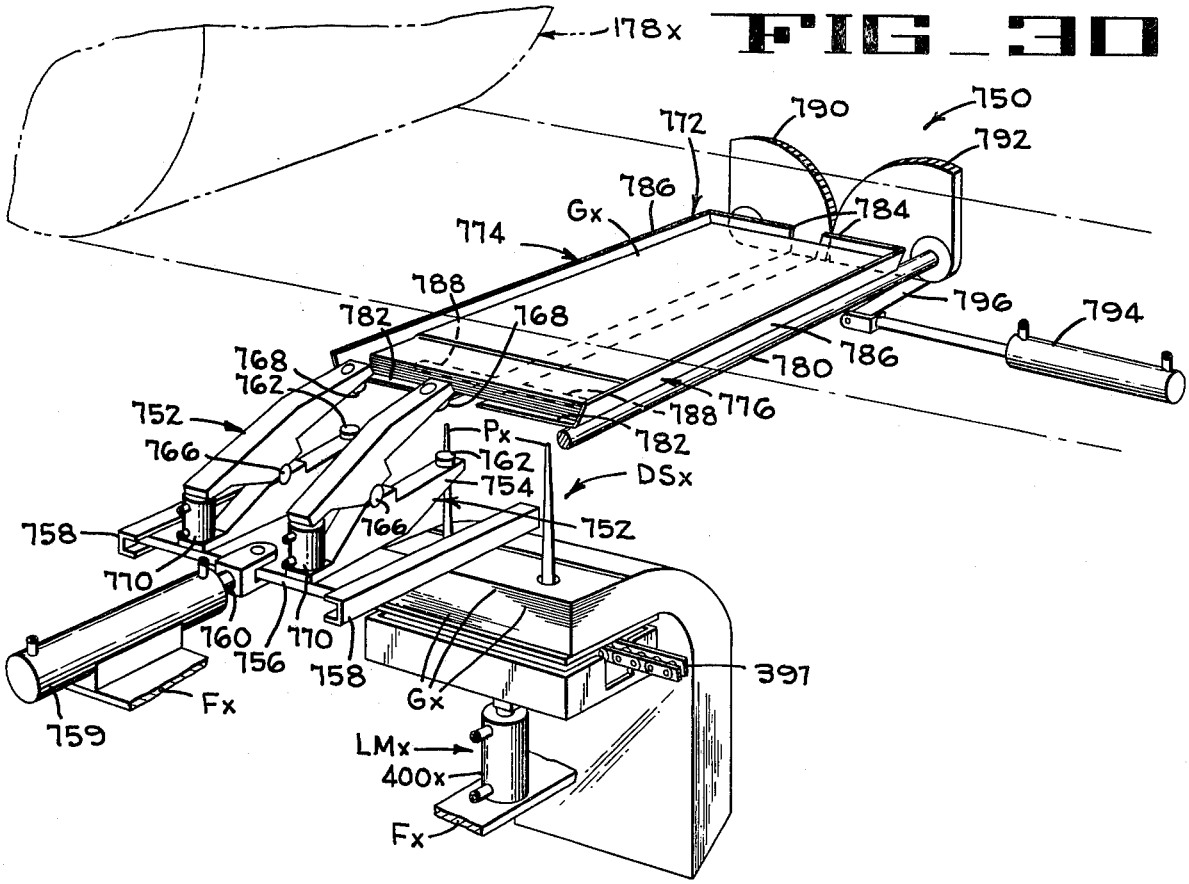
FIG. 30 is a diagrammatic perspective illustrating an alternate hole punching and wicket loading mechanism in an inactive position which may be used with all embodiments of the invention.
Figure 31:
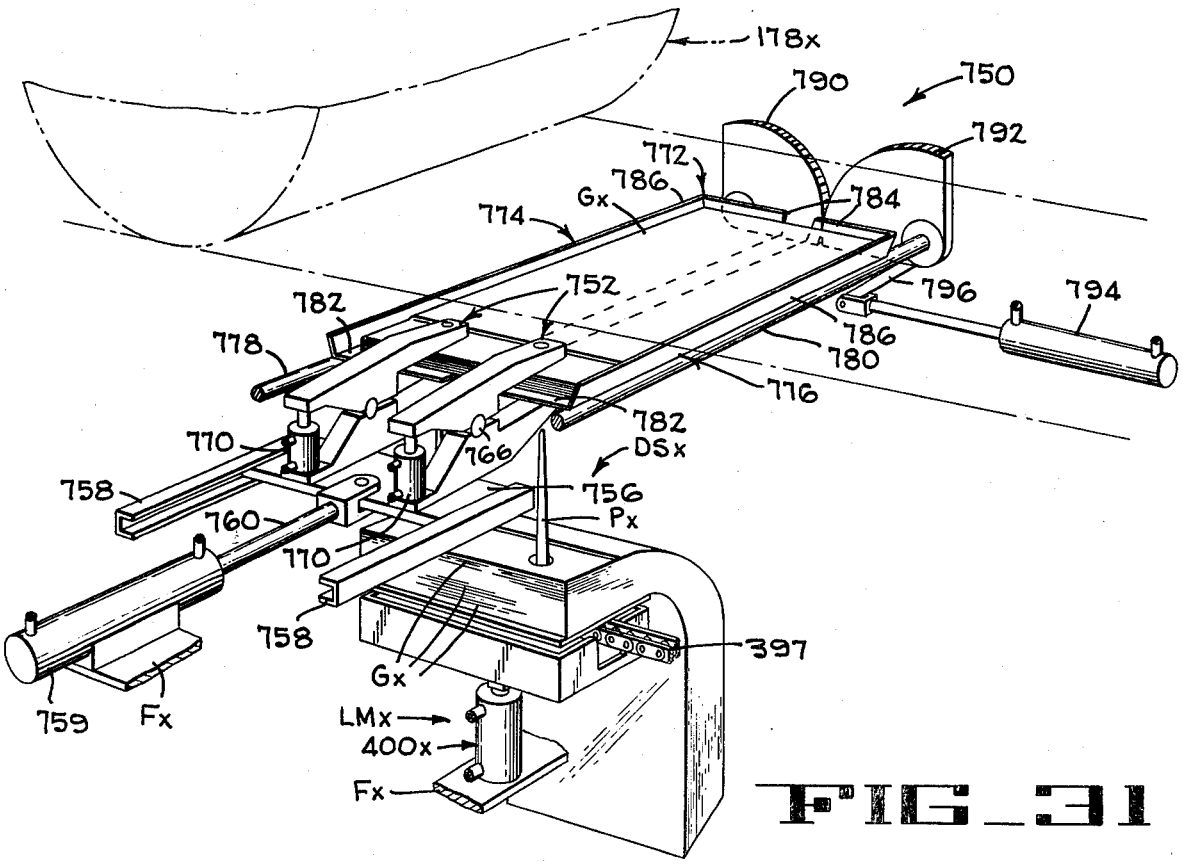
FIG. 31 is a perspective similar to FIG. 29 but illustrating a group of bags being punched.
Figure 32:
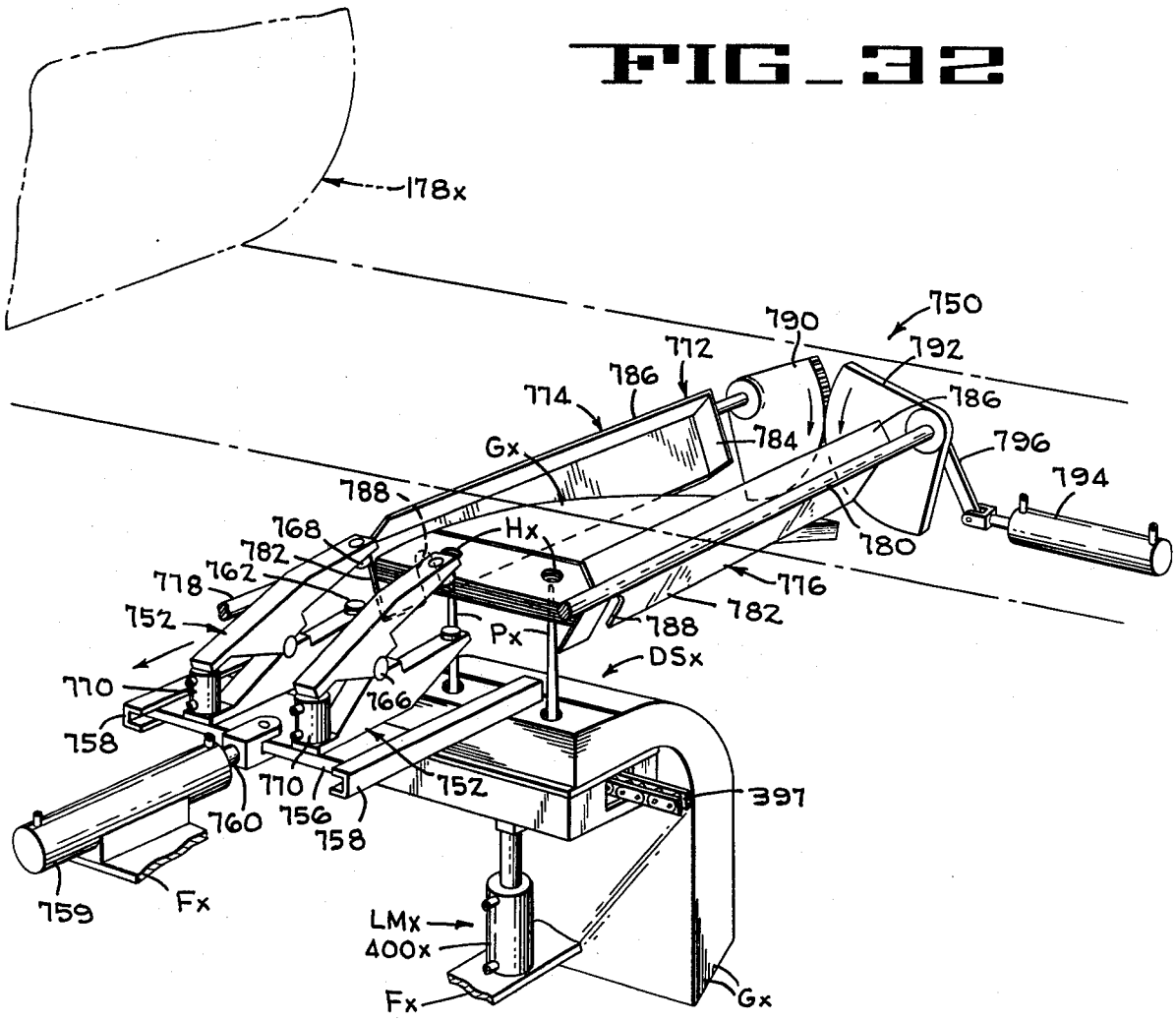
FIG. 32 is a perspective similar to FIG. 29 but illustrating the punched group of bags being deposited on wicket pins.

An alternate hole punching and wicket loading mechanism 750 is diagrammatically illustrated in FIGS. 30–32, and may be used with any of the several illustrated embodiments of the invention.

The wicket conveyor **397*x* (FIGS. 2 and 7**) and the lift mechanism LMx for lifting the wicket pins Px are the same (but at a slightly lower elevation) as that described in the first embodiment of the invention and accordingly will not be repeated.

The hole punching and wicket loading mechanism 750 (FIG. 30) comprises a pair of scissors type punches 752 spaced the appropriate distance apart and having the lower jaws 754 thereof rigidly secured to a slide plate slidably received on channel slides 758 of the frame Fx. The plate 756 is reciprocated into and out of punching position in timed relation with the movement of the associated cyclically moving discharge drum **178*x* by an air cylinder 759 mounted on the frame Fx and with its piston rod 760 connected to the slide plate 756**.

The lower jaw 754 of each scissors punch 752 is provided with a tubular punch die 762 and is pivotally connected to an upper jaw 764 by a pivot pin 766. Each upper jaw carries a punch anvil 768 which enters the tubular die 762 when activated into its hole punching position by an air cylinder 770 disposed between the opposite ends of the upper and lower jaws.

Each group Gx of bags is discharged from the bag collecting drum **178*x* into a tray 772 at the discharged station DSx. The tray 772 includes two pivotal tray sections 774 and 776 mounted on shafts 778 and 780, respectively, which shafts are journaled on the frame Fx. Each tray section 774, 776 includes a flat bag supporting surface 782 with an end wall 784 and a side wall 786 integral therewith to cradle the discharge group Gx of bags therein. Each tray section also includes wicket pin receiving slots 788 as best illustrated in FIG. 32. The tray sections 774 and 776 are pivoted from their bag group receiving horizontal positions (FIGS. 30 and 31) to their inclined group releasing position (FIG. 32) by a pair of meshing gear segments 790 and 792 secured to the shafts 778 and 780, respectively and are actuated by an air cylinder 794 connected to a lever 796 that is rigid with the gear segment 792**.

In operation of the alternate hole punching and wicket loading mechanism 750, the group Gx of bags are discharged from the bag collecting drum **178*x*** as previously described in regard to any of the five embodiments of the invention.

After the bags have been received in the tray 772 and the drum **178*x* has been moved from above the tray as indicated in FIG. 30, the air cylinder 759 is actuated to move the punches 752 into hole punching position and then the air cylinders 770 are actuated to punch the holes Hx as diagrammatically illustrated in FIG. 32. Immediately after the holes Hx have been punched, air pressure to the cylinders 770 is reversed thereby returning the scissors jaws to their open position. The air pressure to the cylinder 759 is then reversed thus returning the punches 752 to the position illustrated in FIG. 30** but with holes punched in all of the bags in the group Gx.

The wicket pins Px are then momentarily raised a sufficient distance so that the upper ends of the pins move through the holes Hx by activating air cylinder **400*x*. Substantially simultaneously as the pins Px penetrate the holes, the air cylinder 794 is activated to open the tray sections 774 and 776 as diagrammatically illustrated in FIG. 32 thus releasing the bag group Gx onto the pins Px. The direction of high pressure air into the cylinder 794 and 400*x* is then reversed thereby returning the pins Px to their lower positions and closing the tray sections 774 and 776** in readiness to receive the next group of bags.

Although it is preferable to raise and lower the pins Px as above described, it will be apparent that the tray 772 rather than the pins Px, may be raised and lowered if desired.

If it is desired to connect all bags in each group together, heated pins (not shown) may be carried by the upper jaws 764 of each punch 752. When the jaws are closed to punch the holes Hx, the heated pins will penetrate the bags and melt some of the thermosealing material to weld all bags in the group together.

Figure 33:
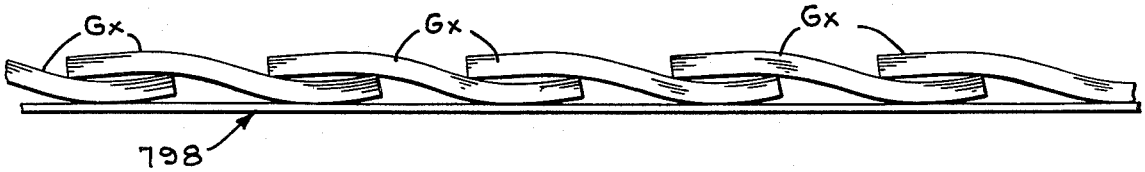
FIG. 33 is a diagrammatic side elevation of a bag group receiving conveyor which receives the groups in shingled orientation.

If wicketing is not desired by the customer, the groups Gx of bags received from any of the several described embodiments of the invention (including the loading mechanism 750 FIG. 30) may be deposited onto an indexing or continuously moving conveyor 798 in shingled form as indicated in FIG. 33.

From the foregoing description it will be apparent that bags, sheets, or other sheet-like articles are continuously formed from a web of thin flexible material. The articles are then continuously advanced at even intervals along a first path, are collected or accumulated in groups each including a predetermined number of articles. The groups of articles are collected on the periphery of a drum that rotates and is also cyclically moved along a second path. While moving along the second path, each group of articles is discharged by rolling the group out onto a collecting mechanism with the speed of roll-out being such that no relative movement exists, in the direction of the second path, between the group of articles and the group receiving mechanism.

Although the best mode contemplated for carrying out the present invention has been herein shown and described it will be apparent that modification and variation may be made without departing from what is regarded to be the subject matter of the invention.

We claim:

1. An article accumulating mechanism comprising means for continuously moving a row of equally spaced articles along a first predetermined path, means defining at least one rotatable article collecting drum, means defining at least one article clamping unit on said drum, drive means for rotating said drum and also for cyclically moving said drum bodily along a second predetermined path in timed relation with the movement of the articles for moving said clamping unit into several different positions along said first path to grip said spaced articles, means for actuating said clamping unit for gripping an article each time said clamping unit moves into position to grip an article from said first path and for collecting a plurality of gripped articles while said rotating drum moves through one cycle along said second path, and means for discharging the collected group of articles from said one clamping unit while moving said collecting drum along said second path.

2. An apparatus according to claim 1 wherein said first path includes an article collecting portion tangent to said drum from which the articles are sequentially stripped by said clamping unit, and wherein the center of said second path is spaced a distance substantially equal to the radius of said drum from said first path at said point of tangency.

3. An apparatus according to claim 2 and additionally comprising means for receiving a group of articles at a discharge station, and wherein the peripheral speed of the drum when moving past said discharge station in an article discharging direction along said second path precludes relative motion between the group of articles and said means for receiving said group thereby rolling out the group of articles into said station.

4. An apparatus according to claim 3 wherein the peripheral speed of said drum at the tangent points between said drum and said article collecting portion of said first path is the same as the speed of the articles being gripped.

5. An apparatus according to claim 2 wherein said article collecting portion of said first path is a linear portion.

6. An apparatus according to claim 2 wherein said article collecting portion of said first path is an arcuate portion.

7. An apparatus according to claims 2 or 3 wherein a plurality of clamping units are provided on said article collecting drum.

8. An apparatus according to claim 7 wherein said drum includes three of said article clamping units, and wherein each clamping unit accumulates a full group of 25 articles per cycle, and wherein said gripping units sequentially discharge one full group of articles per cycle.

9. An apparatus according to claim 3 wherein said means for receiving a group of articles are wicket pins held from movement parallel to said second path during discharge of a full group of articles onto said pins.

10. An apparatus according to claims 1 or 3 wherein the articles are thermosealing bags and wherein said means for moving the row of bags along the first path includes a continuously driven bag making drum.

11. An apparatus according to claim 10 wherein said means for moving the bags along a first path also includes a conveyor having a linear bag engaging run along which said several different positions for gripping said bags are located.

12. An apparatus according to claim 11 wherein said clamping unit on said article collecting drum grips the bags when moving tangent to said linear article engaging run.

13. An apparatus according to claim 10 wherein said clamping unit and said article collecting drum grips the articles when moving along the arcuate surface of said article making drum.

14. An apparatus according to claim 10 wherein said means for moving the articles along the first path includes the arcuate surface of at least one additional rotating drum and wherein a plurality of evenly spaced clamping units are mounted on said one additional rotary drum, and additionally comprising means to actuate said clamping units on said additional drum for gripping articles from said first path and for subsequently releasing a group of accumulated articles into said clamping unit on said article collecting drum.

15. An apparatus according to claim 14 wherein said clamping units on said additional drum grip the articles directly from an arcuate portion of said first path.

16. An apparatus according to claim 15 wherein said arcuate portion of said first path is a portion of the article making drum.

17. An apparatus according to claim 14 wherein said additional clamping units on said additional drum grip the articles directly from a linear portion of said first path.

18. An article accumulating mechanism comprising; means for continuously moving a row of equally spaced articles along a first path, means defining a rotatable article accumulating drum, means defining a plurality of article clamping units on said drum, drive means for rotating said drum and also for cyclically moving said drum bodily along a second predetermined path in timed relation with the movement of the articles for moving said clamping units into position to grip said spaced articles, means for actuating each clamping unit during each cycle for gripping and removing a plurality of articles from said first path during each cycle and for accumulating a plurality of articles in each of said clamping units, and means for discharging one full group of articles from one clamping unit during each cycle of said accumulating drum.

19. An apparatus according to claim 18 wherein said paths are linear path.

20. An apparatus according to claim 19 wherein three clamping units are provided on said drum and wherein at least eight articles are collected in each clamping unit per cycle and twenty five articles are discharged from only one of said clamping unit per cycle.

21. An apparatus according to claim 18 wherein said paths are arcuate paths.

22. An article accumulating mechanism comprising; means for continuously moving a row of equally spaced articles along a first predetermined path, means defining a rotatable article accumulating drum, means defining a plurality of article clamping units on said drum for collecting and accumulating articles from said first path, means defining a rotatable and cyclically movable article group collecting drum for collecting the accumulated articles, means defining an article group clamping unit on said collecting drm for receiving groups of predetermined numbers of articles from said article clamping units, drive means for rotating said accumulating drum in timed relation with the movement of the articles along said first path, means for actuating each article clamping unit a plurality of times during each cycle for gripping and removing a plurality of articles from said first path during each cycle for accumulating a plurality of articles in each of said clamping units, second drive means for rotating said article group collecting drum and also for cyclically moving said drum bodily along a second predetermined path in timed relation with the movement of the articles accumulating drum for moving said group clamping unit into position to grip the accumulated group of predetermined number of articles from each article clamping unit, means for actuating said group clamping unit for gripping one group of predetermined articles per cycle from said accumulating drum and for discharging said one group per cycle from said group collecting drum.

23. An apparatus according to claim 22 wherein said first path is an arcuate path.

24. An apparatus according to claim 22 wherein said first path is a linear path.

25. An apparatus according to claim 22 wherein three article clamping units are provided on said accumulating drum and a single group clamping unit is provided on said group collecting drum, and wherein at least eight articles are collected in each article clamping unit per cycle and a group of twenty five articles are received and discharged from said group collecting drum per cycle.

26. An apparatus according to claim 25 wherein each of the three article clamping units is a double clamping unit having a first finger which opens to receive a new article while a second finger maintains gripping control on the already accumulated articles under the newly added article, said first finger thereafter clamping the new article to the accumulated articles permitting said means for actuating said article clamping unit to open said second finger which moves out from under the newly added articles and thereafter return in clasping engagement upon the accumulated articles including the new article.

* * * * *